US010412505B2

(12) United States Patent
Rusconi Beltrami et al.

(10) Patent No.: US 10,412,505 B2
(45) Date of Patent: Sep. 10, 2019

(54) SOUND CONVERTER ARRANGEMENT WITH MEMS SOUND CONVERTER

(71) Applicant: USOUND GMBH, Graz (AT)

(72) Inventors: Andrea Rusconi Beltrami, Vienna (AT); Ferruccio Bottoni, Graz (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 15/572,825

(22) PCT Filed: May 10, 2016

(86) PCT No.: PCT/EP2016/060426

§ 371 (c)(1),
(2) Date: Nov. 9, 2017

(87) PCT Pub. No.: WO2016/180820

PCT Pub. Date: Nov. 17, 2016

(65) Prior Publication Data

US 2018/0139543 A1 May 17, 2018

(30) Foreign Application Priority Data

May 13, 2015 (DE) ..... 10 2015 107 560

(51) Int. Cl.
*H04R 1/08* (2006.01)
*H04R 9/08* (2006.01)
(Continued)

(52) U.S. Cl.
CPC ..... *H04R 19/04* (2013.01); *H04R 1/04* (2013.01); *H04R 1/24* (2013.01); *H04R 17/00* (2013.01);
(Continued)

(58) Field of Classification Search
CPC ..... H04R 19/005; H04R 1/08; H04R 9/08; H04R 11/04; H04R 17/02; H04R 21/02
(Continued)

(56) References Cited

U.S. PATENT DOCUMENTS 3,953,675 A 4/1976 Babb
6,832,523 B2 12/2004 Benzel et al.
(Continued)

FOREIGN PATENT DOCUMENTS

DE 10053326 A1 5/2002
DE 10201220819 A1 5/2013
(Continued)

OTHER PUBLICATIONS

International Search Report (PCT/EP2016/060426), dated Sep. 22, 2016.
(Continued)

*Primary Examiner* — Suhan Ni
(74) *Attorney, Agent, or Firm* — Dority & Manning, P.A.

(57) ABSTRACT

The present invention relates to a sound transducer assembly with a MEMS sound transducer for generating and/or detecting sound waves in the audible wavelength spectrum. The MEMS sound transducer includes a first cavity, and the sound transducer assembly includes an ASIC electrically connected to the MEMS sound transducer. The ASIC is embedded in a first substrate, and the first MEMS sound transducer is arranged on a second substrate. The first substrate and the second substrate are electrically connected to one another, and the first cavity is at least partially formed in one of the first substrate and the second substrate.

17 Claims, 18 Drawing Sheets

(51) Int. Cl.

| | |
|---|---|
| ***H04R 11/04*** | (2006.01) |
| ***H04R 19/04*** | (2006.01) |
| ***H04R 1/04*** | (2006.01) |
| ***H04R 1/24*** | (2006.01) |
| ***H04R 17/00*** | (2006.01) |
| ***H04R 19/00*** | (2006.01) |
| *H04R 1/28* | (2006.01) |

(52) U.S. Cl.
CPC ..... *H04R 19/005* (2013.01); *H04R 1/2876* (2013.01); *H04R 1/2884* (2013.01); *H04R 2201/003* (2013.01)

(58) Field of Classification Search
USPC ..... 381/175, 176, 369
See application file for complete search history.

(56) References Cited

U.S. PATENT DOCUMENTS

| | | | | |
|---|---|---|---|---|
| 8,520,878 | B2 * | 8/2013 | Inoda | H04R 1/021 381/175 |
| 8,577,063 | B2 * | 11/2013 | Yang | B81B 7/0061 381/175 |
| 8,917,897 | B2 * | 12/2014 | Nakagawa | H04R 1/04 381/360 |
| 8,989,422 | B2 * | 3/2015 | Tanaka | H04R 19/005 381/175 |
| 9,332,330 | B2 | 5/2016 | Elian et al. | |
| 2003/0000768 | A1 | 1/2003 | Maurique et al. | |
| 2003/0024764 | A1 | 2/2003 | Fox | |
| 2010/0206658 | A1 | 8/2010 | Slotte | |
| 2012/0063627 | A1 | 3/2012 | Takashima et al. | |
| 2012/0087521 | A1 * | 4/2012 | Delaus | B81C 1/00238 381/174 |
| 2012/0250897 | A1 | 10/2012 | Michel et al. | |
| 2013/0075836 | A1 | 3/2013 | Lee | |
| 2013/0126991 | A1 | 5/2013 | Ehrenpfordt et al. | |
| 2013/0193533 | A1 | 8/2013 | Vos et al. | |
| 2013/0343590 | A1 | 12/2013 | Nakagawa et al. | |
| 2015/0023523 | A1 | 1/2015 | Elian et al. | |
| 2015/0035094 | A1 | 2/2015 | Laermer et al. | |
| 2015/0210542 | A1 | 7/2015 | Dehe | |
| 2015/0256917 | A1 | 9/2015 | Schelling et al. | |
| 2016/0234619 | A1 | 8/2016 | Hsu et al. | |
| 2016/0241953 | A1 | 8/2016 | Elian et al. | |
| 2017/0048624 | A1 | 2/2017 | Clerici et al. | |

FOREIGN PATENT DOCUMENTS

| | | | |
|---|---|---|---|
| DE | 102011086722 | A1 | 5/2013 |
| DE | 102014100238 | | 7/2014 |
| DE | 102013214823 | A1 | 2/2015 |
| DE | 102014214153 | A1 | 2/2015 |
| DE | 102014203881 | | 9/2015 |
| DE | 102014211190 | A1 | 12/2015 |
| EP | 2073569 | A1 | 6/2009 |
| EP | 2393307 | A2 | 12/2011 |
| EP | 2544461 | A1 | 1/2013 |
| WO | WO 2015/162248 | A1 | 10/2015 |

OTHER PUBLICATIONS

International Preliminary Report on Patentability (PCT/EP2016/060426), dated Dec. 12, 2017.
German Search Report for DE 10 2015 107 560.1, dated Jan. 27, 2016.
International Search Report and Written Opinion of the International Searching Authority and English Translation thereof, dated Feb. 2, 2019, 17 pages.
Chinese Office Action, Chinese Application No. 201680027830.0, dated Feb. 2, 2019, 8 pages.

* cited by examiner

SOUND CONVERTER ARRANGEMENT WITH MEMS SOUND CONVERTER

CROSS-REFERENCE TO RELATED APPLICATIONS

This application claims priority to International Application Serial No. PCT/EP2016/060426, filed May 10, 2016, which claims priority to German Application No. 1020150107560.1, filed May 13, 2015. International Application Serial No. PCT/EP2016/060426 is hereby incorporated herein in its entirety for all purposes by this reference.

FIELD OF THE INVENTION

The present invention relates to a sound transducer assembly with an ASIC electrically connected to a MEMS sound transducer for generating and/or detecting sound waves in the audible wavelength spectrum. Such sound transducer assemblies can be very small in size, and are therefore installed, for example, in hearing aids, in-ear headphones, mobile phones, tablet computers and other electronic devices that offer little installation space, as a loudspeaker and/or a microphone.

BACKGROUND

The term "MEMS" stands for microelectromechanical systems. A MEMS sound transducer for sound generation or a MEMS loudspeaker is known, for example, from DE 10 2012 220 819 A1. Sound is generated by a swivel-mounted membrane of the MEMS loudspeaker. Such sound transducer arrangements are specifically constructed according to the acoustic and other requirements of the respective application area, and consist of a multiple number of different elements. A major disadvantage of such sound transducer assemblies is that their production is correspondingly complex, time-consuming and costly.

BRIEF SUMMARY OF THE INVENTION

The task of the present invention is to provide a sound transducer assembly that is simple in construction and able to be produced.

The task is solved by a sound transducer assembly with the characteristics described below and by a production method with the characteristics described below.

A sound transducer assembly with a first MEMS sound transducer, which comprises a first cavity, and with an ASIC electrically connected to the first MEMS sound transducer, is proposed. The MEMS sound transducer is a microelectromechanical system for generating and/or detecting sound waves in the audible wavelength spectrum. Preferably, the MEMS sound transducer is electromechanically, electrostatically and/or piezoelectrically driven. The ASIC is an electronic application-specific integrated circuit suitable for operating the MEMS sound transducer. The term "cavity" is to be understood as an empty space by means of which the sound pressure of the MEMS transducer can be reinforced. In accordance with the invention, the ASIC is embedded in a first substrate, while the first MEMS sound transducer is arranged on a second substrate. Thus, the first substrate with the integrated ASIC and the second substrate with the at least partially integrated MEMS sound transducer provide two separate components; i.e, components that are manufactured separately from one another. The first and the second substrates are connected to one another. Thus, they feature a common connection area, in which they abut directly against one another. The connection between the two substrates is preferably established by means of a material bond, whereas they are preferably glued to one another. However, in addition or alternatively, the connection can also be established by means of a form closure and/or a force closure. The two substrates are connected to one another in such a manner that the ASIC and the first MEMS sound transducer are coupled or connected to one another in an electrically conductive manner.

In the production of sound transducer assemblies, a certain number of rejects inevitably arises. With the sound transducer assembly in accordance with the invention, the additional costs arising from the rejects can be reduced by initially producing the substrates separately from one another. Thereafter, the proper functioning of their respective at least one electronic components, i.e. the ASIC or the MEMS sound transducer, is verified. Only after the positive verification of their functionality—i.e., if it is ensured that the ASIC and/or the MEMS sound transducer have not suffered any damages during the respective integration or embedding process—are they connected to one another; in particular, glued to one another. In this manner, it can be ensured that, in each case, only two functional substrates are connected to one another to form a sound transducer assembly.

Furthermore, a production method for such a sound transducer assembly is proposed, which, in accordance with the invention, comprises the following steps:

arranging or embedding the ASIC in a first substrate, arranging the MEMS sound transducer on a second substrate, connecting the first substrate and the second substrate in a manner electrically conductive with one another.

Both the proposed transducer assembly and the proposed method for its production offer many advantages. If the ASIC is completely integrated in the first substrate, and/or the first cavity is at least partially formed in the first and/or second substrate, the sound transducer assembly can be formed in a highly installation space-saving manner.

Thanks to the modular construction with at least two separate substrates, of which the first substrate contains the ASIC and the second substrate carries the MEMS sound transducer, the sound transducer assembly can be produced much more efficiently.

The individual modules, which comprise either a first substrate and an ASIC (hereinafter referred to as an "ASIC module") or a second substrate and a MEMS sound transducer (hereinafter referred to as an "MEMS module") can be produced, tested and (if necessary) temporarily stored, independently of one another in respective sub-processes. Each of these sub-processes can be specifically optimized. Moreover, the design of the ASIC module and the MEMS module can be specifically optimized.

The connection of an ASIC module and a MEMS module can take place at a late stage of the production process. Such connection can take place in particular through soldering, conductive adhesive and/or in another suitable manner, such that the first and the second substrates are connected to one another at least electrically and preferentially also in a positive-locking, force-fitting and/or firmly bonded manner.

Due to the possibility of the separate production of the respective modules, the ASIC modules and/or the MEMS modules can also be manufactured in different variants and then combined to form different sound transducer assemblies, for example by different MEMS module variants being combined with an ASIC module variant or a MEMS module variant being combined with different ASIC module variants. This enables the flexible design of an extensive product family of various sound transducer assemblies while taking advantage of economies of scale at the same time.

Due to the possibility of separate testing, individual faulty modules can be detected selectively and early in the process and sorted out, such that, on the one hand, only two error-free modules are assembled together to form a transducer assembly and, on the other hand, only a few defective modules must be disposed of. This reduces the amount of rejects, saves valuable resources, protects the environment and reduces costs. Moreover, the connection between the two modules or between the first and the second substrate is preferably formed in a releasable manner, such that, even later, in the event of a repair, only the defective of the two modules must be replaced by a new module.

It is advantageous if the first cavity is formed at least partially in the first and/or second substrate. As a result, a particularly large volume of the cavity can be achieved.

In an advantageous additional form of the invention, a second MEMS sound transducer is arranged on a third substrate. At this, the first substrate and the third substrate are electrically connected to one another. Accordingly, such a sound transducer assembly comprises the first substrate with the ASIC, the second substrate with the first MEMS sound transducer and the third substrate with the second MEMS sound transducer. Preferably, the first substrate is arranged between the second substrate and the third substrate. The second MEMS sound transducer preferentially also comprises a cavity, whereas such second cavity is formed at least partially in the first and/or third substrate.

Thus, the modular structure of the sound transducer assembly advantageously makes it possible to connect the ASIC module to an additional MEMS module, which comprises a third substrate and a second MEMS sound transducer. Moreover, such connection can take place in particular through soldering, conductive adhesive and/or in another suitable manner, such that the first and the second substrate are connected to one another at least electrically and preferentially also in a positive-locking, force-fitting and/or firmly bonded manner.

It is understood that the characteristics and advantages already mentioned above with respect to the ASIC module and the MEMS module essentially also apply to the additional MEMS module.

With a sound transducer assembly with two MEMS modules, the two MEMS modules can be formed essentially with the same or different characteristic properties. In both cases, the sound transducer assembly equipped with two MEMS modules typically features better performance, particularly in the form of a bandwidth and/or greater sound pressure that is larger than if it were equipped with only a single MEMS module.

In accordance with an advantageous additional form, the two cavities of the MEMS sound transducers are separated from one another by an intermediate wall of the first substrate, whereas the two cavities thus do not influence one another. Preferably, the intermediate wall features at least one connection opening extending from the first cavity to the second cavity, such that there is a flow connection between the two cavities and the volume of one cavity is increased by the volume of the other cavity. Thus, the sound transducer assembly can be formed in a highly installation space-saving manner, with a relatively large acoustically effective cavity volume.

It is advantageous if the intermediate wall features at least one stiffening element, in particular in the form of a rib, by which a stabilization of the intermediate wall is achieved and a deformation and/or an oscillation of the intermediate wall is thus prevented, but at least substantially reduced.

Preferably, the two cavities feature volumes of different sizes. Thus, cavity volume may be a characteristic feature in which the MEMS modules differ.

It is advantageous if an equalization hole and/or a pressure equalization channel are formed in at least one of the substrates. The equalization hole and/or the pressure equalization channel connect at least one of the cavities to the surrounding area, such that pressure equalization can take place. Such a pressure equalization hole has the advantage that, in certain frequency ranges, the air pressure can be equalized. This can improve acoustic performance and quality.

It is advantageous if at least one of the substrates, preferably all, is formed as a printed circuit board or PCB, and/or is manufactured in PCB technology.

In an advantageous additional form of the invention, at least one cavity is at least partially filled with a porous material. This results in an effective increase in the surface area within the cavity and a virtual increase in the cavity volume, by which greater sound pressure and better low-frequency reproduction can be achieved. The porous filling material may be provided in one piece or multiple pieces and feature one or more specific pore sizes. Thus, the nature of the porous material may also be a characteristic feature in which the MEMS modules differ. Since the cavity is preferably still openly accessible until the first substrate is connected to the second substrate, the porous material, even if it is present in one piece, can be introduced very easily.

In accordance with a preferred additional form, the sound transducer assembly features a housing part. Such housing part offers, in particular, protection for the sensitive MEMS sound transducer(s). Preferably, the housing part features at least one acoustic inlet/outlet opening, which is preferably arranged laterally on an outer surface of the sound transducer assembly. Preferably, the housing part is connected to at least one of the substrates in such a manner that at least partially, at least one sound-conducting channel is formed between the housing part and at least one of the substrates. By means of the sound-conducting channel, the sound generated by a MEMS sound transducer acting as a MEMS loudspeaker advantageously can be amplified and/or selectively guided in a direction of the acoustic outlet opening, or the sound entering at the acoustic inlet opening and to be detected can be intensified and/or selectively guided in the direction of the MEMS sound transducer acting as a MEMS microphone. Thanks to the sound-conducting channel, the acoustic inlet/outlet opening can be positioned essentially arbitrarily on an outer surface of the sound transducer assembly, in particular at an installation-oriented top side and/or at a side surface.

Furthermore, the at least one sound-conducting channel preferably features a first section, which is in particular formed between the housing part and the at least one substrate, and/or a second section, which is in particular formed in the housing part, partially or completely. Thereby, advantageously, no additional components are necessary for the formation of the sound-conducting channel. Furthermore, the sound transducer assembly can thus be formed in a manner that is highly installation space-saving. At this, the second section is preferably arranged directly adjacent to the acoustic inlet/outlet opening, and/or at least partially surrounds it.

In an additional preferential embodiment, the sound transducer assembly features a sound-conducting element, with preferably at least one, in particular concave, sound-conducting edge. Such sound-conducting element is preferably arranged between the housing part and at least one substrate, in particular in the transition area between the first and second sections of the sound-conducting channel. The sound-conducting element may be formed individually or molded on the housing part and/or on a substrate. Advantageously, the sound-conducting element and/or the sound-conducting edge is formed in such a manner that sound generated by the MEMS sound transducer can be bundled into the acoustic inlet/outlet opening, in particular in the direction of the second section of the sound-conducting channel, and/or that sound to be detected by the MEMS sound transducer can be bundled into the MEMS sound transducer, in particular in the direction of the first section of the sound-conducting channel.

If the sound transducer assembly comprises a first and a second MEMS sound transducer, preferably each of the MEMS sound transducers is assigned to a sound-conducting channel, each of which provides the connection to an acoustic inlet/outlet opening. Particularly to save installation space, even with a transducer assembly comprising two MEMS sound transducers, only one acoustic inlet/outlet opening can be provided. The second section of the first sound-conducting channel and the second section of the second sound-conducting channel can then be formed as a common section, at least in the area of the acoustic inlet/outlet opening. The sound-conducting element can then preferentially be formed and arranged in such a manner that it separates the first section of the first sound-conducting channel from the first section of the second sound-conducting channel. More preferentially, the sound-conducting element features an extension, which projects in particular from the first section into the second section.

In an advantageous additional form of the invention, the first, second and/or third substrate is a PCB substrate (i.e., a printed circuit board) that is constructed from one or preferably several layers, whereas the several layers are arranged in a manner sandwiched over one another and/or connected to one another, preferably in a firmly bonded manner. In particular, the first substrate may feature a recess for integrally receiving the ASIC, which is formed, for example, as a circuit board cavity with a sufficiently large volume, in such a manner that the ASIC can be arranged or embedded therein. In addition to the ASIC, additional components, in particular passive components such as electrical resistors and/or I/O contacts, can also be embedded in the first substrate and/or arranged therein. Preferentially, the housing part and/or the sound-conducting element consist of a material that is different in comparison to the substrate, in particular a plastic and/or metal.

It is advantageous if the substrates are produced separately from one another. At this, with the production of the first substrate, the ASIC is embedded or encapsulated in it. In doing so, the ASIC and/or additional active and/or passive electronic components are completely integrated in the first substrate. Furthermore, it is advantageous if the second substrate is produced separately, together with the MEMS sound transducer. In doing so, the MEMS sound transducer can be fastened, for example, on one side of the second substrate, in particular in a firmly bonded manner. However, in addition or alternatively, the MEMS sound transducer can also be connected to the second substrate in a positive-locking manner. For this purpose, for example, a frame of the MEMS sound transducer is encompassed by the second substrate in a positive-locking manner. However, the membrane can oscillate freely. After each module—i.e., in particular the first module comprising the ASIC and the first substrate and/or the second module comprising the MEMS sound transducer and the second substrate—has been manufactured in a separate production step, such are connected (in particular, glued) to one another in a subsequent production step. Thus, advantageously, the functionality of the module can be checked prior to its final connection, such that rejects and consequently production costs can be reduced.

BRIEF DESCRIPTION OF THE DRAWINGS

Further advantages of the invention are described in the following embodiments. The following is shown.

DESCRIPTION OF EXEMPLARY EMBODIMENTS OF THE INVENTION

In the following description of the figures, in order to define the relationships between the various elements, with reference to the locations of objects shown in the figures, relative terms, such as above, below, up, down, over, under, left, right, vertical and horizontal are used. It it self-evident that such a term may change in the event of a deviation from the location of a device and/or element shown in the figures. Accordingly, for example, in the case of an orientation of a device and/or an element shown inverted with reference to the figures, a characteristic that has been specified as "above" in the following description of the figures would now be arranged "below." Thus, the relative terms are used solely for a more simple description of the relative relationships between the individual devices and/or elements described below.

Figure 1:
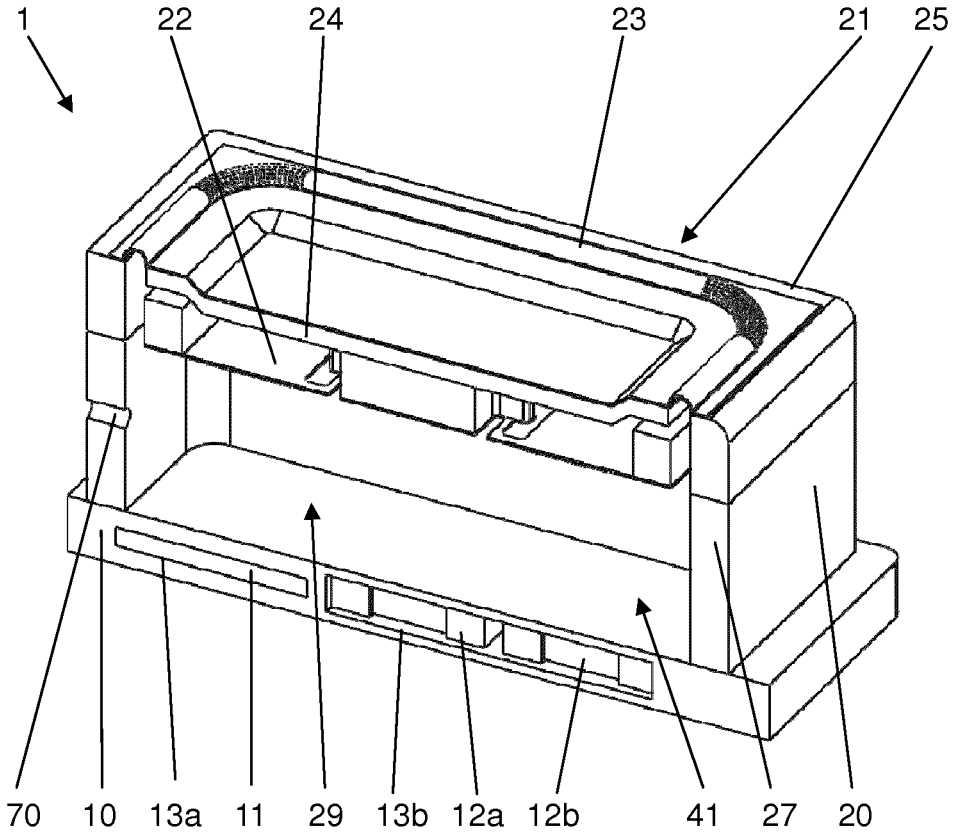
FIG. 1*a* first embodiment of the sound transducer assembly without a housing part in a perspective sectional view, FIG. 2 the first embodiment of the sound transducer assembly without a housing part in a side sectional view, FIG. 3 the first embodiment of the sound transducer assembly without a housing part in another side sectional view, FIG. 4*a* second embodiment of the sound transducer assembly with a housing part in a perspective sectional view, FIG. 5 the second embodiment of the sound transducer assembly with a housing part in a side sectional view, FIG. 6 the second embodiment of the sound transducer assembly without a housing part in another side sectional view, FIG. 7*a* third embodiment of the sound transducer assembly with a housing part in a perspective sectional view, FIG. 8 the third embodiment of the sound transducer assembly in a perspective exploded view, FIG. 9 the third embodiment of the sound transducer assembly with a housing in a perspective overall view, FIG. 10 a fourth embodiment of the sound transducer assembly with a housing and with a cavity filled with porous material in a side sectional view, FIG. 11 a fifth embodiment of the sound transducer assembly with a housing and with a cavity filled with porous material in a side sectional view, FIG. 12 a sixth embodiment of the sound transducer assembly without a housing in a schematically illustrated side sectional view, FIG. 13 a seventh embodiment of the sound transducer assembly without a housing, but with two MEMS sound transducers, in a schematically illustrated side sectional view, FIG. 14 an eighth embodiment of the sound transducer assembly with a housing and two MEMS sound transducers in a side sectional view, FIG. 15 a ninth embodiment of the sound transducer assembly without a housing part in a perspective sectional view, FIG. 16 the ninth embodiment of the sound transducer assembly without a housing part in a side sectional view, FIG. 17 the ninth embodiment of the sound transducer assembly without a housing part in another side sectional view, FIG. 18 a tenth embodiment of the sound transducer assembly with a housing part in a perspective sectional view, FIG. 19 the tenth embodiment of the sound transducer assembly with a housing part in a side sectional view, FIG. 20 the tenth embodiment of the sound transducer assembly without a housing part in another side sectional view, FIG. 21 an eleventh embodiment of the sound transducer assembly without a housing part in a perspective sectional view, FIG. 22 the eleventh embodiment of the sound transducer assembly without a housing part in a side sectional view, FIG. 23 the eleventh embodiment of the sound transducer assembly without a housing part in another side sectional view, FIG. 24 a twelfth embodiment of the sound transducer assembly with a housing part in a perspective sectional view, FIG. 25 the twelfth embodiment of the sound transducer assembly with a housing part in a side sectional view, FIG. 26 the twelfth embodiment of the sound transducer assembly without a housing part in another side sectional view.
Figure 2:
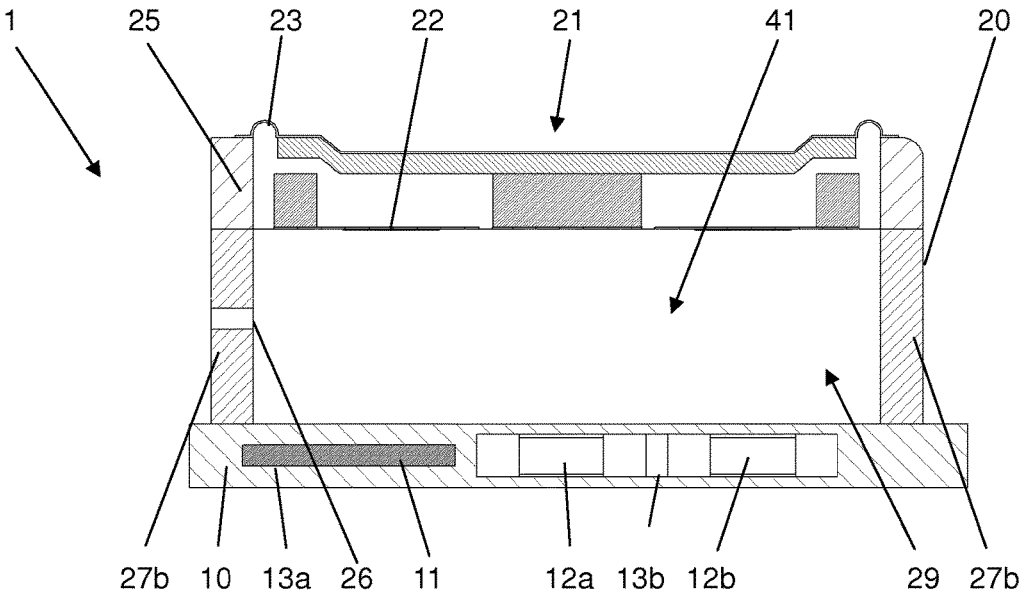
Figure 3:
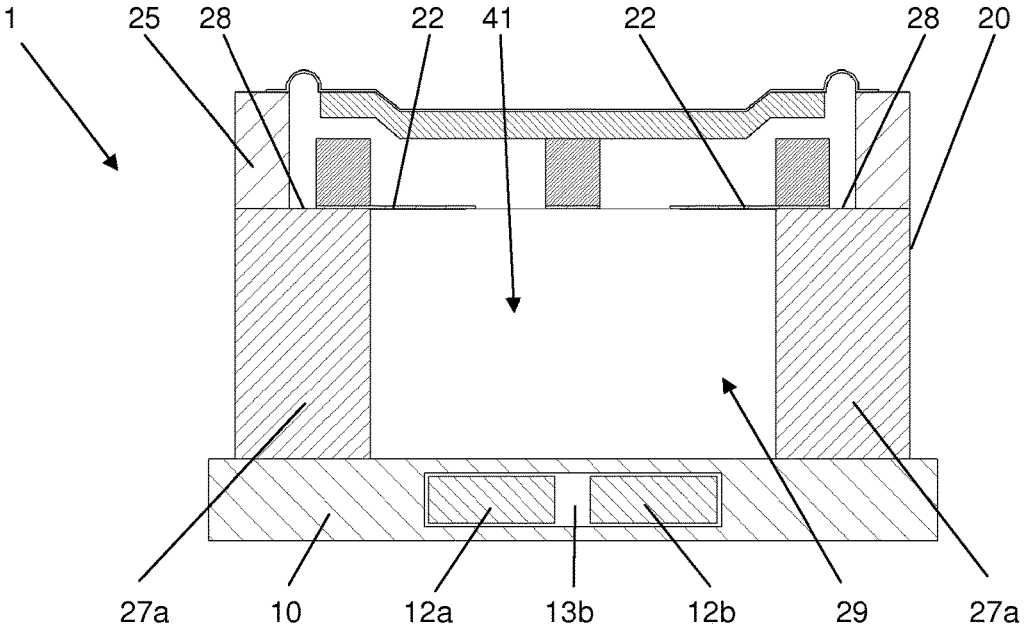

FIGS. 1 to 3 show a first embodiment of a sound transducer assembly 1 in different views. The sound transducer assembly 1 essentially comprises a first substrate 10 formed as a printed circuit board with an ASIC 11 along with a second substrate 20 formed as a printed circuit board with a MEMS sound transducer 21. The MEMS sound transducer 21 is connected to electrical contacts with the ASIC 11 that are not illustrated in detail in the figures. Thus, the MEMS sound transducer 21 can be controlled or operated by means of ASIC 11. The sound transducer assembly 1 has an essentially rectangular basic shape. Having a rectangular basic shape, the sound transducer assembly is simple and inexpensive to produce and is suitable for numerous applications. Alternatively, however, the sound transducer assembly can, in principle, also feature another (in particular, a round) basic form.

The MEMS sound transducer 21 is formed in such a manner it can generate and/or detect sound waves in the audible wavelength spectrum. For this purpose, the MEMS sound transducer 21 comprises, in addition to a MEMS actuator 22, a membrane 23, a membrane plate 24 and a membrane frame 25 as additional components (in particular, acoustic components). The membrane 23, which is made of rubber (for example) is firmly connected, in its edge area, to the membrane frame 25, while, in particular in its central area, it is firmly connected to the membrane plate 24, whereas the membrane plate 24 itself is not connected to the membrane frame 25. Thus, the membrane 23 spans the membrane frame 25 and is stiffened by the membrane plate 24, in particular in its central area. For example, if the MEMS sound transducer 21 is to function as a loudspeaker, it may be excited by means of the ASIC 11 in such a manner that the membrane 23 for generating sound energy is set into oscillation by the MEMS actuator 22 with respect to the membrane frame 25.

The second substrate 20 carries the MEMS actuator 22 and the membrane frame 25 with the membrane 23 fastened to it, whereas the MEMS actuator 22 is arranged below the membrane 23, and whereas the second substrate 20 features a hollow space 29 below the membrane 23 and the MEMS actuator 22. The hollow space 29 is laterally surrounded or bounded by walls 27 of the second substrate 20, while it is closed upwards by the membrane 23. Downwards, the hollow space 29 is closed by the first substrate 10, to which the second substrate 20 is connected. Thus, the hollow space 29 forms the cavity 41 of the MEMS sound transducer 21, which serves in particular to increase the sound pressure of the MEMS sound transducer 21.

As can be seen from FIGS. 1 to 3, the membrane frame 25 essentially features the same outer diameter as the second substrate 20, while the MEMS actuator 22 has a smaller outer diameter than the substrate 20. As can be seen from FIGS. 1 and 2 in comparison with FIG. 3, the essentially opposing wall sections 27*a* of the second substrate 20 are formed to be thicker than the wall sections 27*b* of the second substrate 20, whereas the wall sections 27*a* that are thicker compared to the wall sections 27*b* project into the hollow space 29. The MEMS actuator 22 rests only on the projections 28 formed by the wall sections 27*a*, while the membrane frame 25 rests on both the wall sections 27*a* and 27*b*, in particular in a full circumference. Thus, the MEMS actuator 22 is laterally surrounded by the membrane frame 25.

The MEMS sound transducer 21 and in particular the MEMS actuator 22 and/or the membrane frame 25 may be glued to the second substrate 20. Furthermore, the second substrate 20 may be glued to the first substrate 10.

In order to be able to ensure a pressure equalization between the cavity 41 and the surrounding area during the oscillation of the membrane 23, the sound transducer assembly 1 features at least one pressure equalization channel 70, which, in this embodiment, comprises an equalization hole 26, which preferably is not arranged on one of the thick wall sections 27, but is arranged on one of the thin wall sections 27 of the second substrate 20. Thus, for pressure equalization, air can flow out of the cavity 41 formed by the hollow space 29 through the pressure equalization channel 70 when the membrane 23 is lowered. However, in an analogous manner, air can also flow into the cavity 41 through the pressure equalization channel 70 when the membrane 23 is lifted.

The first substrate 10 features a hollow space 13*a*, which is essentially completely closed. The ASIC 11 is arranged in the hollow space 13*a*. Thus, the ASIC 11 is completely embedded in the first substrate 10. In addition to the ASIC 11, the sound transducer assembly 1 features electrical (in particular, passive) additional components 12*a*, 12*b*, such as, for example, electrical resistors and/or I/O contacts. Such additional components 12*a*, 12*b* are also embedded in the first substrate 10, whereas they are arranged in the additional hollow space 13*b* of the substrate 10, which is also essentially completely closed. Alternatively, the additional electronic components 12*a*, 12*b* could also be arranged together with the ASIC 11 in the hollow space 13*a*.

FIGS. 4 to 26 show additional embodiments of the sound transducer assembly 1, whereas, in each case, differences with respect to the first embodiment, as already described, are essentially addressed. Thus, with the following description, the additional embodiments for the same characteristics use the same reference signs. To the extent that these are not explained once again in detail, their design and mode of action correspond to the characteristics described above.

The differences described below can be combined with the characteristics of the respective preceding and subsequent embodiments.

Figure 4:
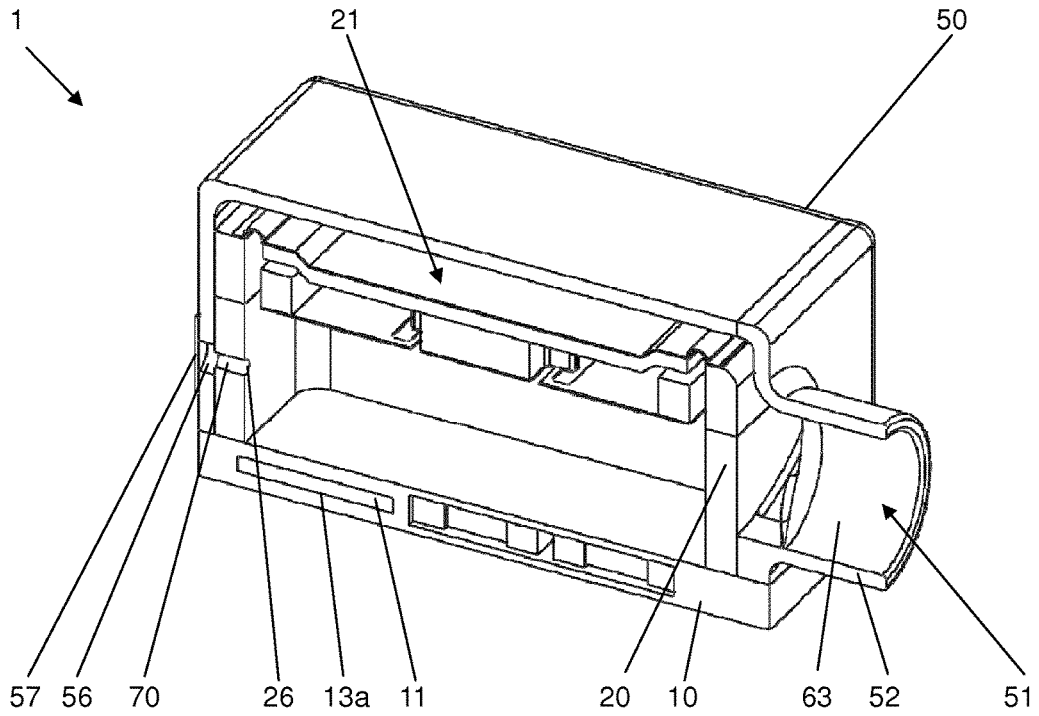
Figure 5:
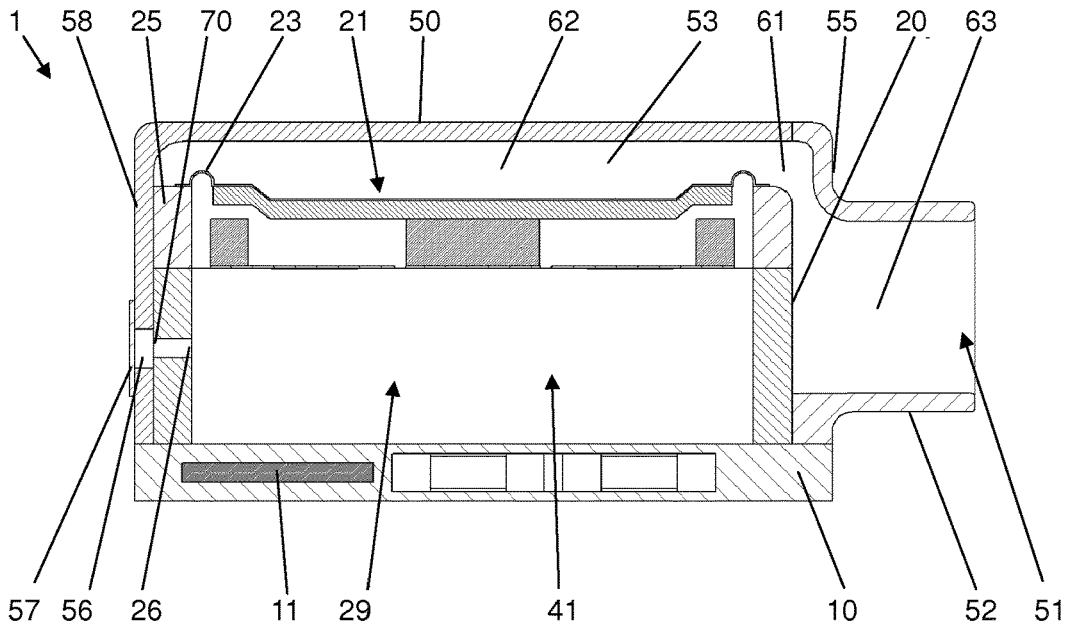
Figure 6:
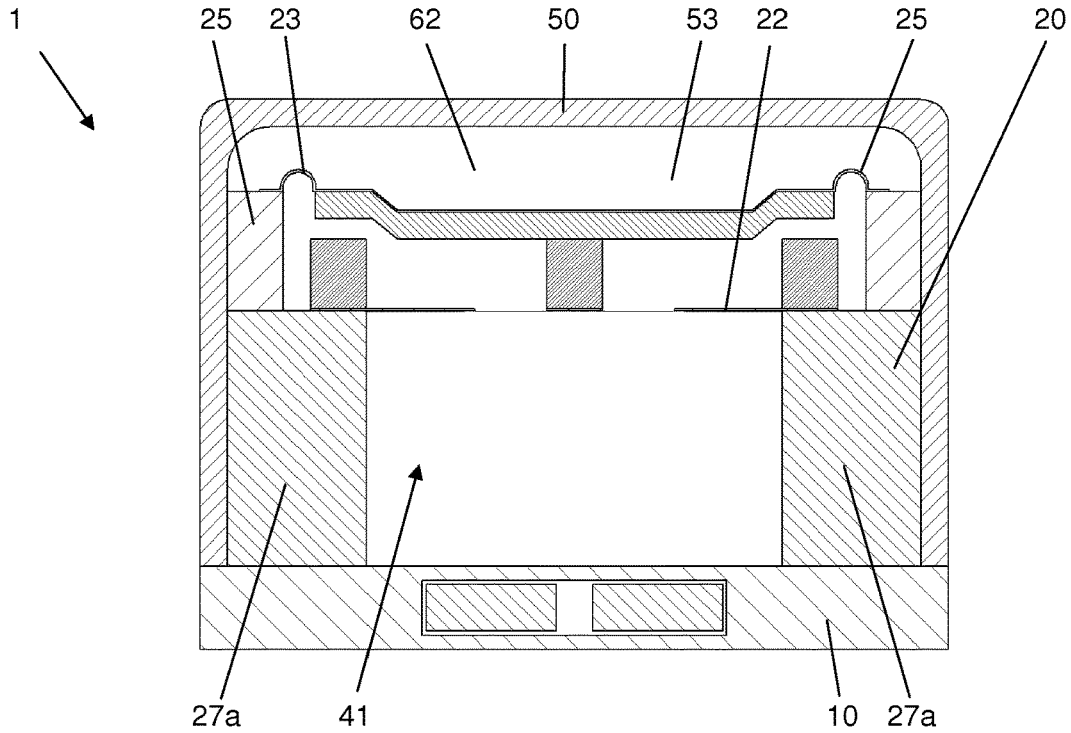

FIGS. 4 to 6 show a second embodiment of the sound transducer assembly 1 in different views. In contrast to the first embodiment, with the second embodiment of the sound transducer assembly 1, a housing part 50 is additionally provided. In particular, such housing part 50 provides protection for the MEMS sound transducer 21. The housing part 50 features a hollow space 53, in which the second substrate 20 and the MEMS sound transducer 21 are essentially completely accommodated, and which is closed downwards from the first substrate 10, with which the housing part 50 is connected.

The housing part 50 also features an acoustic inlet/outlet opening 51, which is arranged laterally on the outer surface 55 of the housing part and thus also the sound transducer assembly. In addition, the housing part 50 is connected to the first substrate 10 in such a manner and in particular also dimensioned in such a manner that, between the housing part 50 and the second substrate 20 with the MEMS sound transducer 21, at least a first section 62 of a sound-conducting channel 61 is formed. A second section 63 of the sound-conducting channel 61 is formed in the housing part 50 itself. For this purpose, the housing part 50 features a tubular projection 52 in the area of the acoustic inlet/outlet opening 51. As a result, no additional components are necessary for the formation of the sound-conducting channel 61. In other words, the sound-conducting channel 61 is at least partially formed by the fact that the hollow space 53 of the housing part 50 is not completely filled by the second substrate 20 and the MEMS sound transducer 21.

Sound can be directed and/or amplified by means of the sound-conducting channel 61 from the MEMS sound transducer 21 to the acoustic inlet/outlet opening 51 and/or vice versa. Thanks to the sound-conducting channel 61, the acoustic inlet/outlet opening 51 can at this be positioned essentially arbitrarily on the outer surface 55 or another outer surface of the sound transducer assembly 1, in particular at an installation-oriented top side and/or at a side surface.

The housing part 50 also features an acoustic equalization hole 56, which is arranged laterally on, the outer surface 58 of the housing part 50. At this, the equalization hole 56 corresponds to the equalization hole 26 and, like this, belongs to the pressure equalization channel 70 of the sound transducer assembly 1. In this example, the equalization hole 56 has a larger diameter than the equalization hole 26. So that no dirt and/or liquid can arrive in the cavity 41 through the pressure equalization channel 70, in this example, the equalization hole 56 is covered with an elastic closure element 57. The pressure equalization functionality is nevertheless ensured, since the elastic closure element 57 can deform in accordance with the pressure prevailing in the cavity 41.

Figure 7:
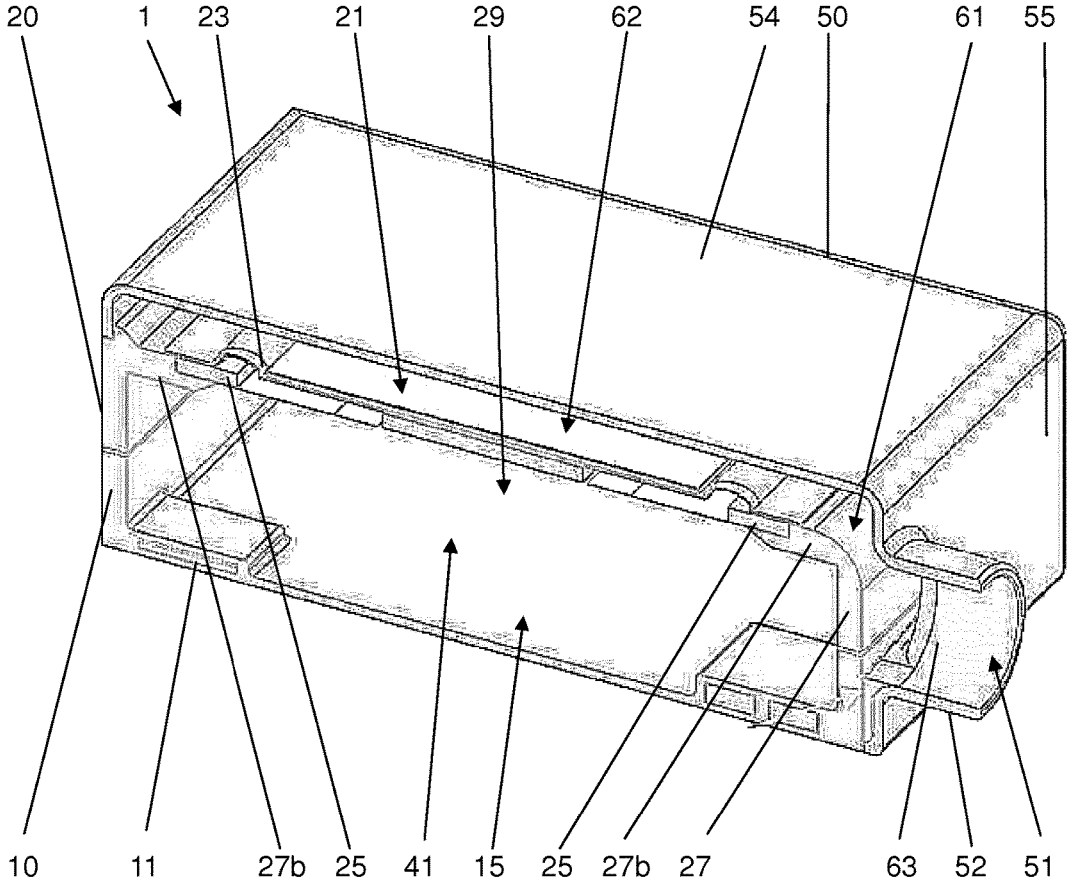
Figure 8:
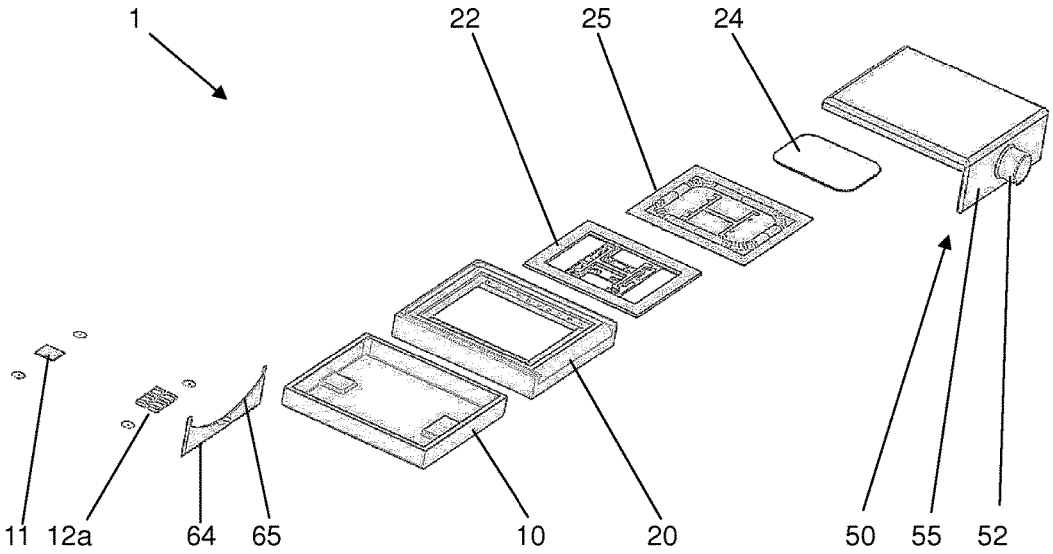
Figure 9:
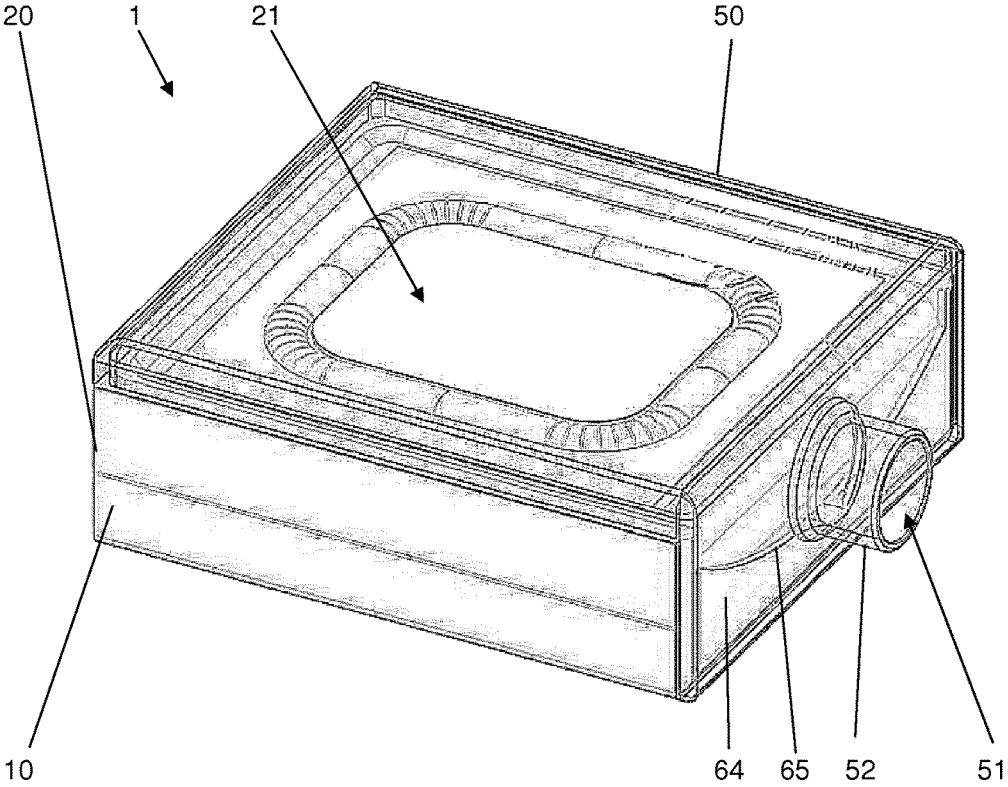

FIGS. 7 to 9 show a third embodiment of the sound transducer assembly 1 in different views. As an essential difference with respect to the first and second embodiments, with the third embodiment, the cavity 41 is formed in part by a hollow space of the first and second substrates 10, 20, respectively.

As can be seen in particular from FIGS. 7 and 8, the membrane frame 25 features essentially the same outside diameter as the MEMS actuator 22, whereas such outside diameters are smaller than the outside diameter of the second substrate 20. However, each of the walls 27 of the second substrate 20, which laterally bound the hollow space 29 of the second substrate, features at its upper area wall sections **27*b* projecting into the hollow space 29, which provide a preferably full-circumference support 28 for the MEMS actuator 22, whereas the membrane frame 25 also rests on the outer edge area of the MEMS actuator 22. Thus, in this example as well, the second substrate 20 carries the MEMS actuator 22 along with the membrane frame 25 with the membrane 23 fastened to it, whereas the MEMS actuator 22 is arranged below the membrane 23 and whereas the second substrate 20 features the hollow space 29, which is closed upwards by the membrane 23, below the membrane 23 and the MEMS actuator 22**.

Downwards, the hollow space 29 of the second substrate 20 is open and adjoins the upwardly open hollow space 15 of the first substrate 10. The hollow space 15 is bounded laterally by walls 16 of the first substrate and is closed downwards by the first substrate 10. The hollow spaces 15 and 29 feature the same diameter, and the lower free ends of the walls 27 correspond to the upper free ends of the walls 16. In the assembled state of the sound transducer assembly 1, the walls 16 of the first substrate 10 are connected (in particular, glued) to the walls 27 of the second substrate 20, whereas the hollow space 15 of the first substrate and the hollow space 29 of the second substrate are arranged one above the other, and then together form the cavity 41 for the MEMS sound transducer 21.

For this example, a pressure equalization channel 70 is not shown in the figures, but may preferably be provided.

In this example, the housing part 50 is formed highly sparingly and features, in addition to the outer surface 55, on which the acoustic inlet/outlet opening 51 is arranged with the tubular projection 52, essentially only the one additional outer surface 54, which in particular provides protection for the MEMS sound transducer 21.

The housing part 50 is nevertheless connected to the first substrate 10 and the second substrate 20 in such a manner that at least a first section 62 of a sound-conducting channel 61 is formed between the housing part 50 and the second substrate 20 with the MEMS sound transducer 21 and the first substrate 10. In this example, the second section 63 of the sound-conducting channel 61 is also formed in the housing part 50 itself and in particular by the tubular projection 52.

To further improve the sound conduction, and in particular to bundle the sound, in this example, the sound-conducting element 64 with a concave sound-conducting edge 65 is provided; it is arranged between the housing part 50 and the first and second substrate within the sound-conducting channel 61. More specifically, the sound-conducting element 64 is arranged in the transition area between the first and second sections 62, 63 of the sound-conducting channel 61. Here, the sound-conducting element is formed as a single component. Alternatively, however, it may also be formed on the housing part 50 and/or on a substrate.

The sound guiding element 64 can be clearly seen, in particular in FIGS. 8 and 9. FIG. 8 shows the sound transducer assembly 1 of the third embodiment in an exploded view. As a result, in addition to the sound-guiding element 64 with the concave sound-conducting edge 65, the other components of the sound transducer assembly 1, such as, for example, the ASIC 11, the substrates 10 and 20 and above all the MEMS actuator 22, the membrane 23 are very clearly visible on the membrane frame 25 and the membrane plate 24. In FIG. 9, the housing part 50 is shown in a semi-transparent manner, such that the components of the sound transducer assembly 1, which are protected behind it, are still clearly visible.

Figure 10:
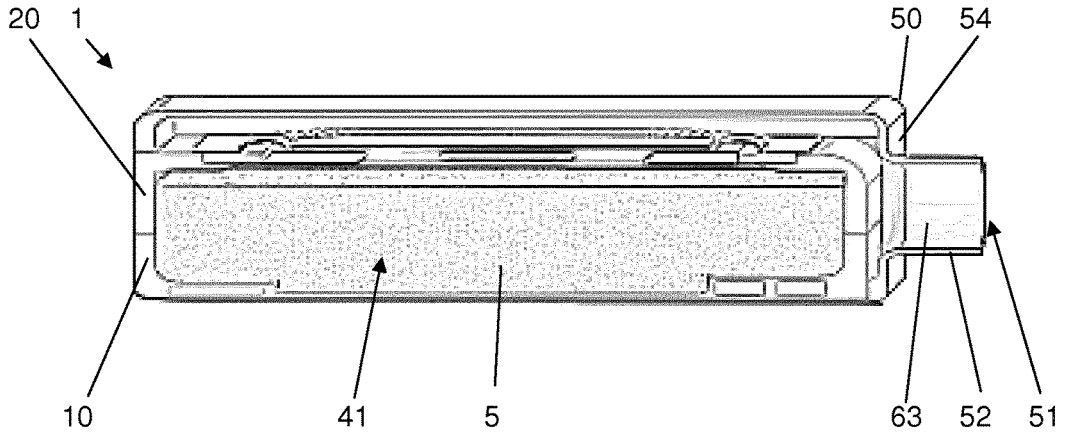

FIG. 10 shows a fourth embodiment of the sound transducer assembly 1. In contrast to the third embodiment, in the case of the fourth embodiment of the sound transducer assembly 1, the cavity 41 is filled, at least approximately completely, with a porous material 5.

Figure 11:
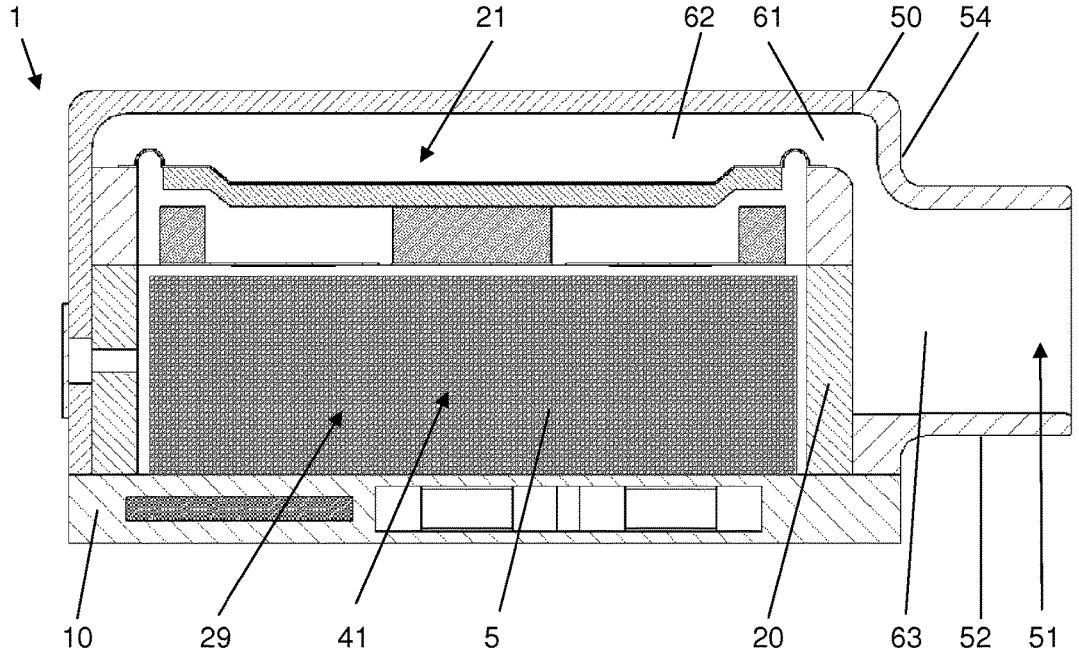

FIG. 11 shows a fifth embodiment of the sound transducer assembly 1. In contrast to the second embodiment, in the case of the fifth embodiment of the sound transducer assembly 1, the cavity 41 is filled, at least approximately completely, with a porous material 5.

The filling of the cavity 41 of the MEMS sound transducer 21 effectively enlarges the surface area within the cavity and virtually increases the cavity volume, by which greater sound pressure and better low-frequency reproduction can be achieved.

Figure 12:
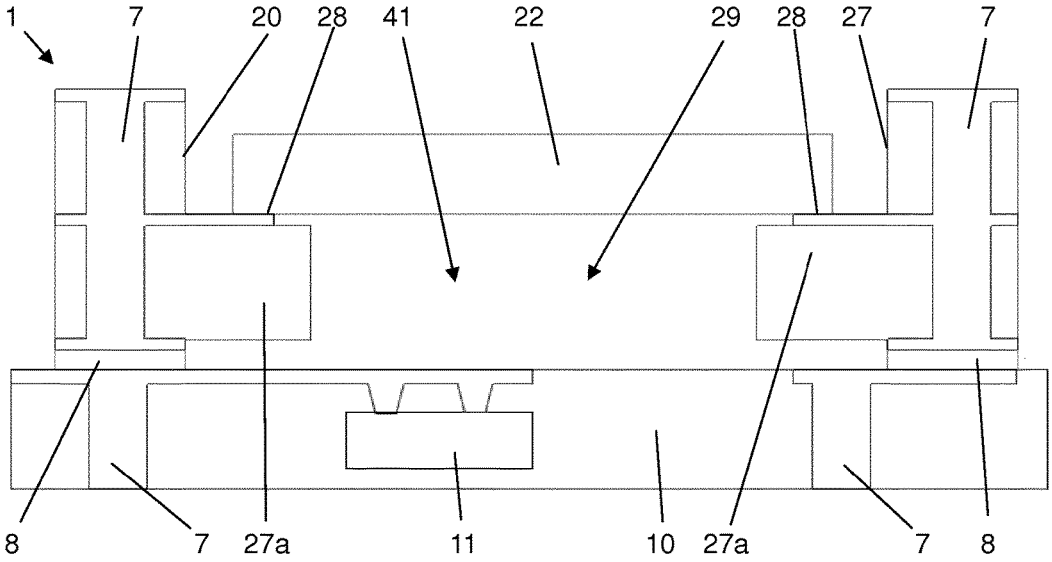

FIG. 12 shows a sixth embodiment of the sound transducer assembly 1. This is a purely schematic illustration of the sound transducer assembly 1, which comprises a first substrate 10 with an ASIC 11 and a second substrate 20 with a MEMS sound transducer 21, but features no housing. Of the MEMS sound transducer 21, only the MEMS actuator 22 is shown here.

Both the first substrate 10 and the second substrate 20 feature conducting paths 7 for the electrical connection of the individual components, in particular ASIC 11 and MEMS actuator 21. The conducting paths 7 of the first substrate 10 are connected to the conducting paths 7 of the second substrate 20 by means of solder connections 8 or electrically conductive adhesive 8. In addition to such electrically conductive connections 8, the two substrates 10, 20 can be connected to one another in a positive-locking, force-fitting and/or firmly bonded manner in another way.

The second substrate 20 features a hollow space 29, which is laterally surrounded or bounded by walls 27 of the second substrate 20, and is closed downwards by the first substrate 10. The walls 27 feature wall sections 27*a* projecting into the hollow space 29, which provide a support 28 for the MEMS actuator 22, which has a smaller outer diameter than the second substrate 20. The hollow space 29 is closed upwards by the additional acoustic components of the MEMS sound transducer, which belong to the MEMS actuator 22, but are not shown here. Thus, the hollow space 29 forms the cavity 41 of the MEMS sound transducer.

Figure 13:
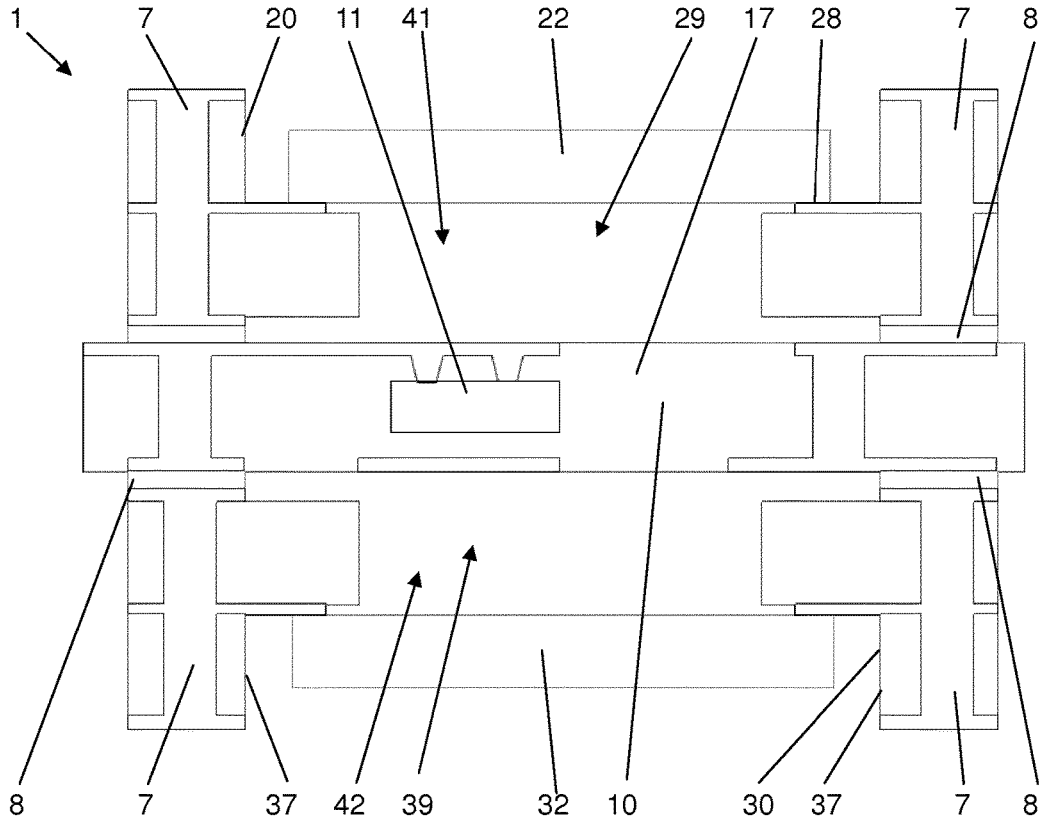

FIG. 13 shows a seventh embodiment of the sound transducer assembly 1. This once again comprises a purely schematic illustration of the sound transducer assembly 1. In contrast to the sixth embodiment, the sound transducer assembly 1 of this seventh embodiment additionally comprises a third substrate 30 with a second MEMS sound transducer, of which only the MEMS actuator 32 is shown.

At this, the first substrate 10 is arranged between the second substrate 20 and the third substrate 30. The third substrate 30 with the second MEMS actuator 32 is constructed essentially like the second substrate 20 with the first MEMS actuator 22; however, the third substrate 30 is arranged in a manner turned by 180° relative to the second substrate 20.

Thus, the third substrate 30 also features conducting paths 7 for the electrical connection of the individual components. The conducting paths 7 of the third substrate 30 are likewise connected to the conducting paths 7 of the first substrate by means of solder connections 8 or electrically conductive adhesive 8. In addition to such electrically conductive connections 8, the two substrates 10, 30 can be connected to one another in a positive-locking, force-fitting and/or firmly bonded manner in another way.

The third substrate 30 features a hollow space 39, which is laterally surrounded or bounded by the walls 37 of the third substrate 30, and is closed upwards by the first substrate 10. The hollow space 39 is closed downwards by the additional acoustic components of the second MEMS sound transducer 31, which belong to the second MEMS actuator 32, but are not shown here. Thus, the hollow space 39 forms the second cavity 42 of the second MEMS sound transducer.

With this seventh embodiment of the sound transducer assembly 1, the first and the second cavity 41, 42 are formed separately, but are formed essentially with the same characteristic properties such as, for example, dimensions and volumes. The two cavities 41, 42 are separated from one another by an intermediate wall 17, which is provided by the first substrate 10, such that the two cavities 41, 42 do not influence one another. Optionally, however, the intermediate wall can also feature at least a connection opening extending from the first cavity 41 to the second cavity 42, but this is not shown here. Such connection opening then enables a flow connection between the two cavities, such that the volume of the one cavity is increased by the volume of the other cavity.

Figure 14:
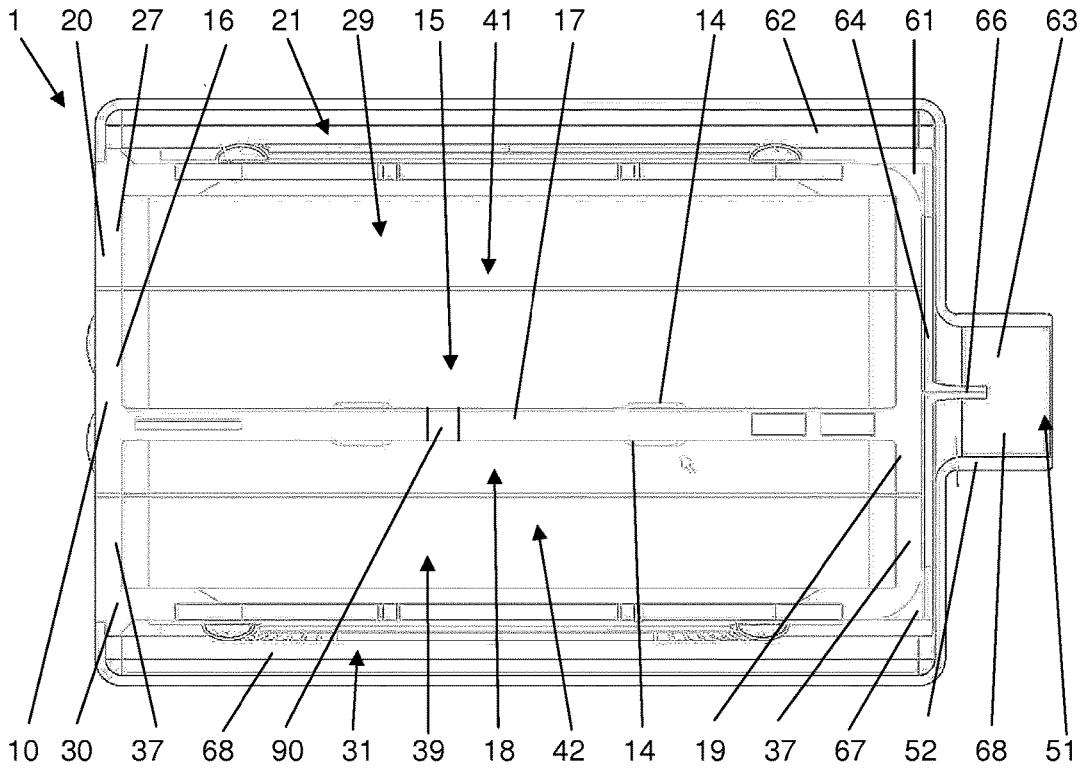

FIG. 14 shows an eighth embodiment of the sound transducer assembly 1. In contrast to the third embodiment, the sound transducer assembly 1 of this eighth embodiment additionally comprises a third substrate 30 with a second MEMS sound transducer 31.

At this, the first substrate 10 is arranged between the second substrate 20 and the third substrate 30. The third substrate 30 with the second MEMS sound transducer 31 is constructed essentially like the second substrate 20 with the first MEMS sound transducer 21; however, the third substrate 30 is arranged in a manner turned by 180° relative to the second substrate 20.

Analogous to the hollow space 15 on its top side, the first substrate 10 on its bottom side features a hollow space 18, which is bounded laterally by walls 19 of the first substrate and is closed upwards by the first substrate 10. Downwards, the hollow space 18 is open and adjoins the upwardly open hollow space 39 of the third substrate 30. The hollow space 39 is laterally surrounded or bounded by the walls 37 of the third substrate 30, and is closed downwards by the membrane 33 of the second MEMS sound transducer 31. The hollow spaces 18 and 39 feature the same diameter, and the lower free ends of the walls 19 correspond to the upper free ends of the walls 37. In the assembled state of the sound transducer assembly 1, the walls 19 of the first substrate 10 are connected (in particular, glued) to the walls 37 of the third substrate 30, whereas the hollow space 18 of the first substrate and the hollow space 39 of the third substrate are arranged one above the other, and then together form the cavity 42 for the MEMS sound transducer 31.

In contrast to the seventh embodiment, with this eighth embodiment, the first and the second cavity 41, 42 feature different characteristic properties and in particular different dimensions and different cavity volumes. This is essentially solely due to the fact that the walls 16 on the top side of the first substrate 10 are formed to be higher than the walls 19 on the bottom side of the first substrate 10.

Simply due to the differently formed cavities 41, 42, even with conditions that are otherwise identical, the first and the second MEMS sound transducers 21, 31 can detect varying sound behavior. In the alternative or as a supplement, the sound behavior of the two MEMS sound transducers can also be selectively influenced, for example, by the specific design of the membranes 23, 33 and/or the MEMS actuators 22, 32. Thus, for example, one of the MEMS sound transducers may function as a woofer and the other MEMS sound transducers as a tweeter, such that such a sound transducer assembly that is so equipped can generate sound in a wider range than, for example, a transducer assembly in accordance with the third embodiment.

The intermediate wall 17 provided by the first substrate 10, which separates the two cavities 41, 42 from one another, features four stiffening elements 14, which are formed as ribs and serve to stabilize the intermediate wall 17. At this, a deformation and/or oscillation of the intermediate wall 17, in particular during the operation of the sound transducer assembly 1, can be substantially reduced or even prevented. In accordance with the present embodiment, the intermediate wall 17 features at least one connection opening 90. The connection opening 90 connects the two cavities 41, 42 to one another.

In this example, the housing part 50 is formed highly sparingly, similar to the third embodiment and features, in addition to the outer surface 55, on which the acoustic inlet/outlet opening 51 is arranged with the tubular projection 52, essentially only the other outer surfaces 54*a* and 54*b*, which in particular provide protection for the first MEMS sound transducer 21 and the second MEMS sound transducer 31.

However, the housing part 50 is also connected to the first substrate 10, the second substrate 20 and the third substrate 30 in such a manner that a first and a second sound-conducting channel 61, 67 are formed. At this, between the housing part 50 and in particular the second substrate 20 with the MEMS sound transducer 21, at least a first section 62 of the first sound-conducting channel 61 is formed, and between the housing part 50 and in particular the third substrate 30 with the MEMS sound transducer 31, at least a first section 68 of second sound-conducting channel 67 is formed.

In particular, in order to save installation space, even with this sound transducer assembly 1, only an acoustic inlet/outlet opening 51 is provided. As such, the second section 63 of the first sound-conducting channel 61 and the second section 69 of the second sound-conducting channel 67 are formed as a common section, which in this example is formed in the housing part 50 itself and in particular by the tubular projection 52 in the area of the acoustic inlet/outlet opening 51.

To further improve the sound conduction and in particular to bundle the sound, the sound-conducting element 64 is also provided in this example. At this, the sound-conducting element 64 is formed and arranged in such a manner that it separates the first section 62 of the first sound-conducting channel 61 from the first section 68 of the second sound-conducting channel 67. For this purpose, the sound-conducting element 64 features an extension 66 projecting into the common second section. In addition, in this example, the sound-conducting element 64 features two concave sound-conducting edges 65*a* and 65*b*, whereas the sound-conducting edge 65*a* is assigned to the first sound-conducting channel 61 and the sound-conducting edge 65*b* is assigned to the second sound-conducting channel 67.

Figure 15:
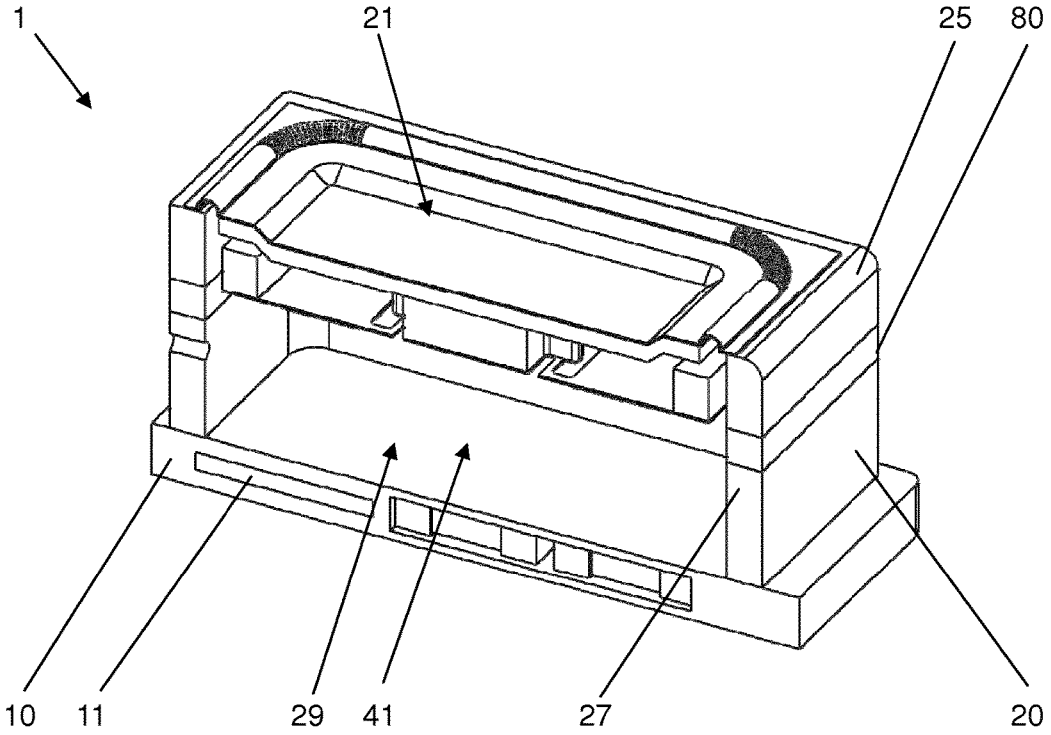
Figure 16:
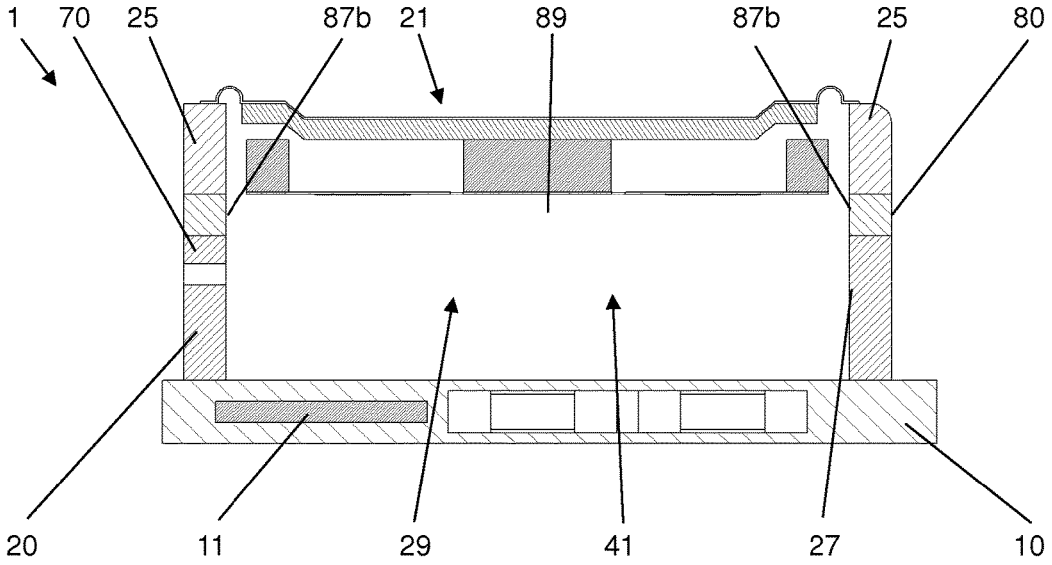
Figure 17:
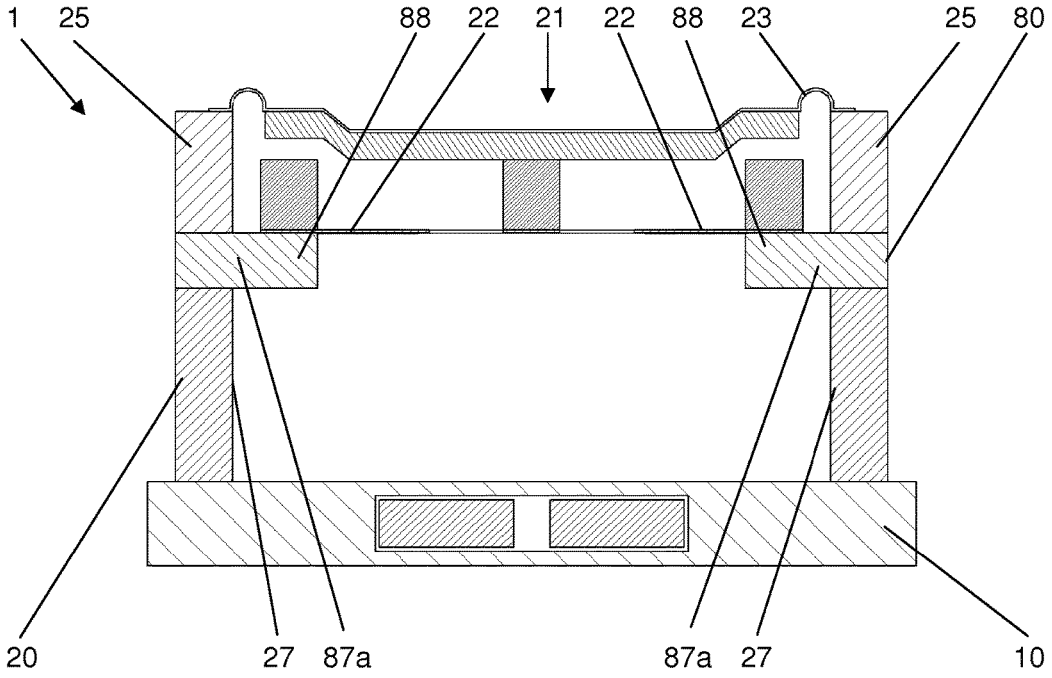

FIGS. 15 to 17 show a ninth embodiment of the sound transducer assembly 1 in different views. In contrast to the first embodiment, with the ninth embodiment of the sound transducer assembly 1, an additional substrate 80 is provided.

Moreover, in the embodiment shown here, the membrane frame 25 features essentially the same outer diameter as the second substrate 20, while the MEMS actuator 22 has a smaller outer diameter than the substrate 20. However, the walls 27 of the second substrate 20, which laterally bound the hollow space 29 of the second substrate 20, do not feature any wall sections projecting into the hollow space 29, which could serve as supports for the MEMS actuator 22. Therefore, the additional substrate 80, which features essentially the same outer diameter as the second substrate 20, rests on the walls 27 of the second substrate 20, in particular in a full circumference.

The additional substrate 80 features a hollow space 89 that is bounded laterally by walls 87 of the substrate 80, whereas the walls 87 feature a substantially lower height than the walls 27 of the second substrate 20. The essentially opposing wall sections 87*a* of the substrate 80 are formed to be thicker than the wall sections 87*b* of the substrate 80, whereas the thicker wall sections 87*a* projecting into the hollow space 89 opposite to the wall sections 87*b*. The MEMS actuator 22 then rests on the projections 88 formed by the wall sections 87*a*, while the membrane frame 25 rests on both the wall sections 87*a* and 87*b*, in particular in a full circumference. Thus, the MEMS actuator 22 is arranged below the membrane 23 and is laterally surrounded by the membrane frame 25.

Thus, the hollow space 89 is closed upwards by the membrane 23. Downwards, the hollow space 89 is open and adjoins the upwardly open hollow space 29 of the second substrate 20, which is closed downwards from the first substrate 10. Then, the hollow spaces 29 and 89 arranged one above the other together form the cavity 41 for the MEMS sound transducer 21. Since the walls 27 of the second substrate 20 do not feature any wall sections projecting into the hollow space 29 that would reduce the hollow space 29, this contributes to the enlargement of the hollow space 29 with formed cavity 41.

Figure 18:
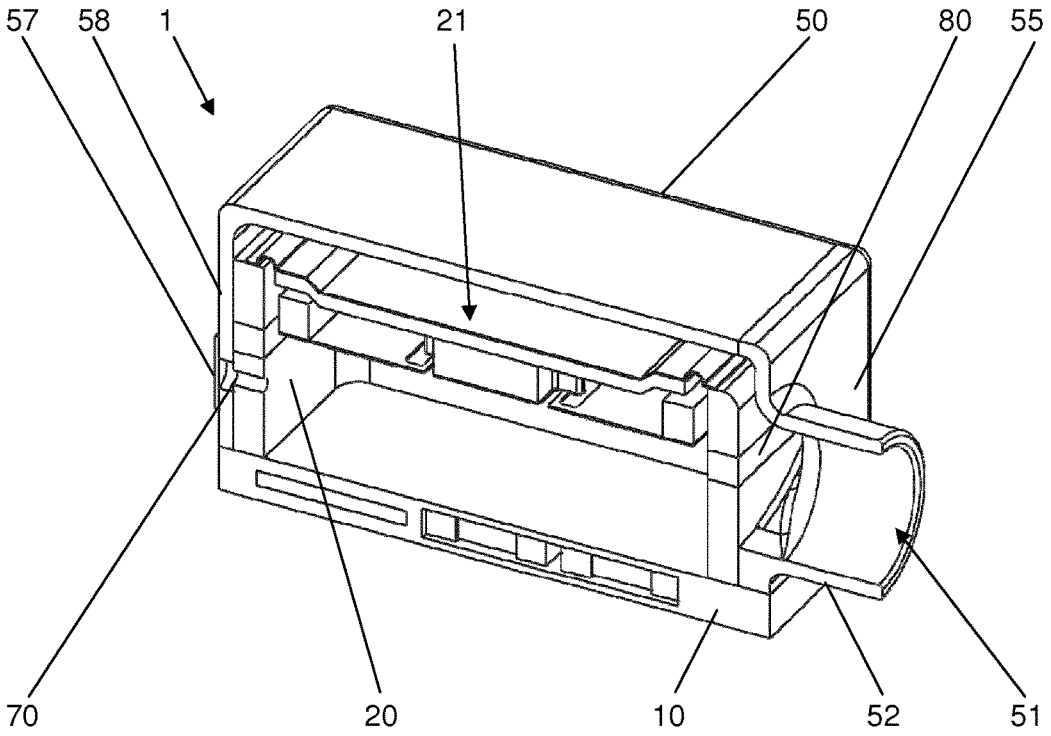
Figure 19:
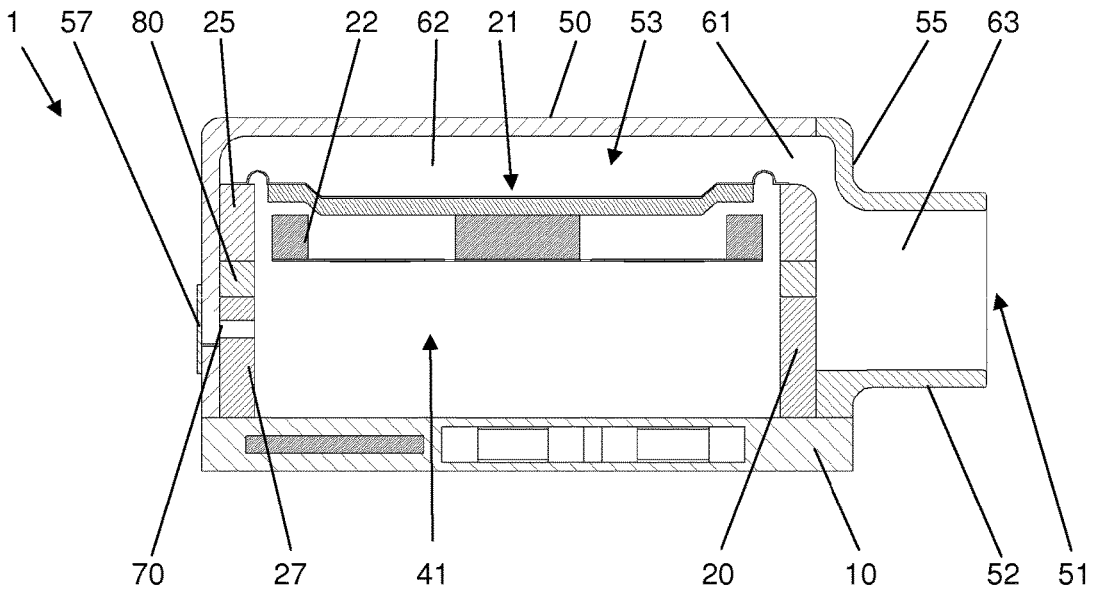
Figure 20:
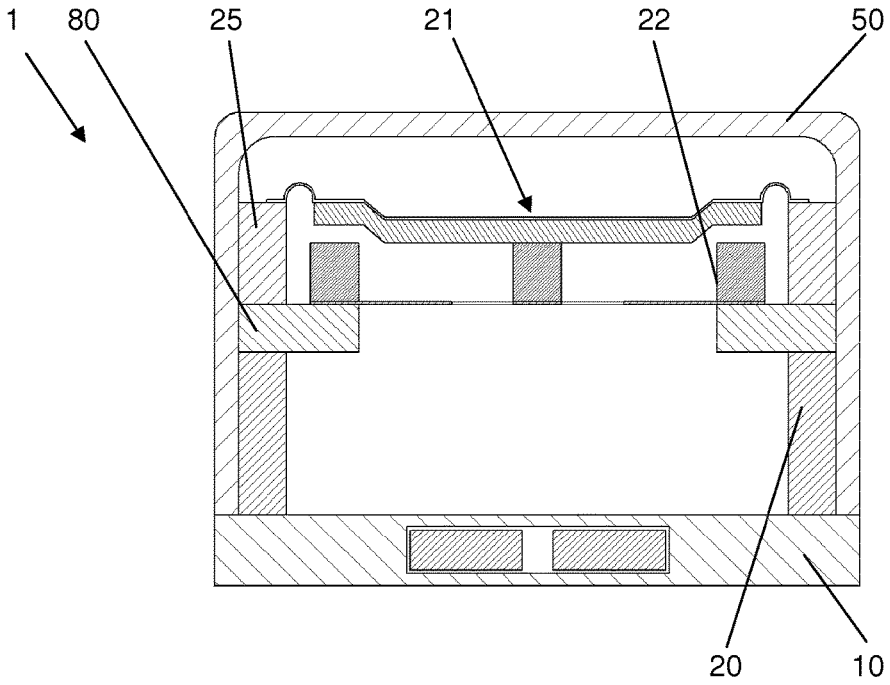

FIGS. 18 to 20 show a tenth embodiment of the sound transducer assembly 1 in different views. In contrast to the ninth embodiment, with the tenth embodiment of the sound transducer assembly 1, a housing part 50, which is essentially formed as in the second embodiment, is additionally provided. In contrast to the second embodiment, with the tenth embodiment of the sound transducer assembly 1, the additional substrate 80 is accommodated in the hollow space 53 of the housing part 50.

Figure 21:
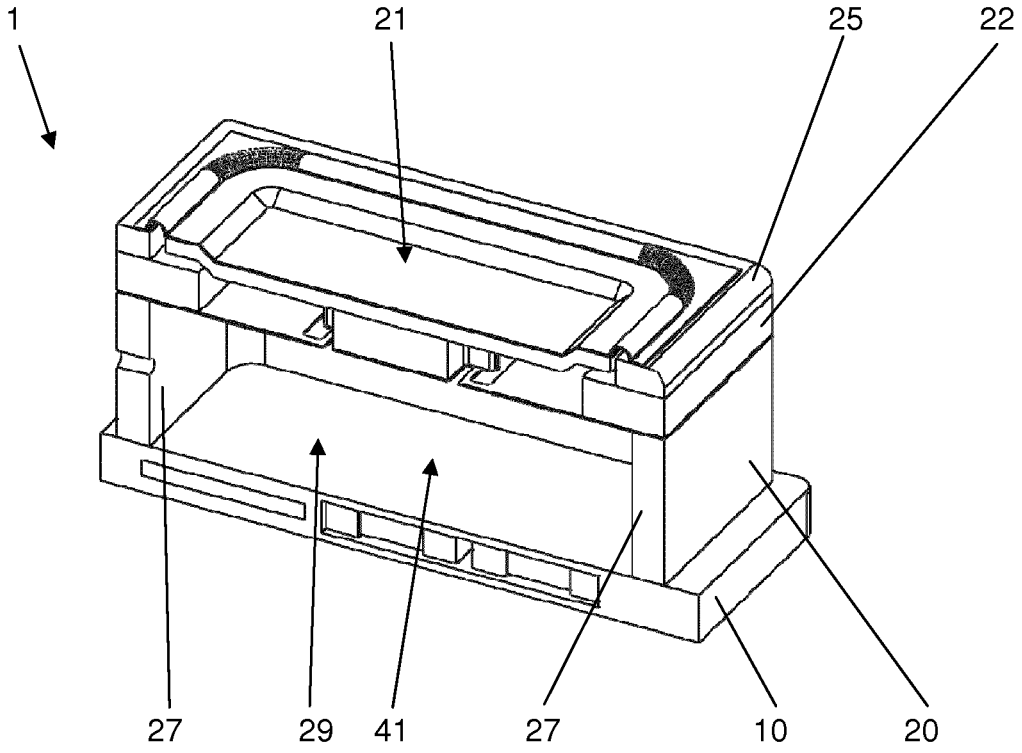
Figure 22:
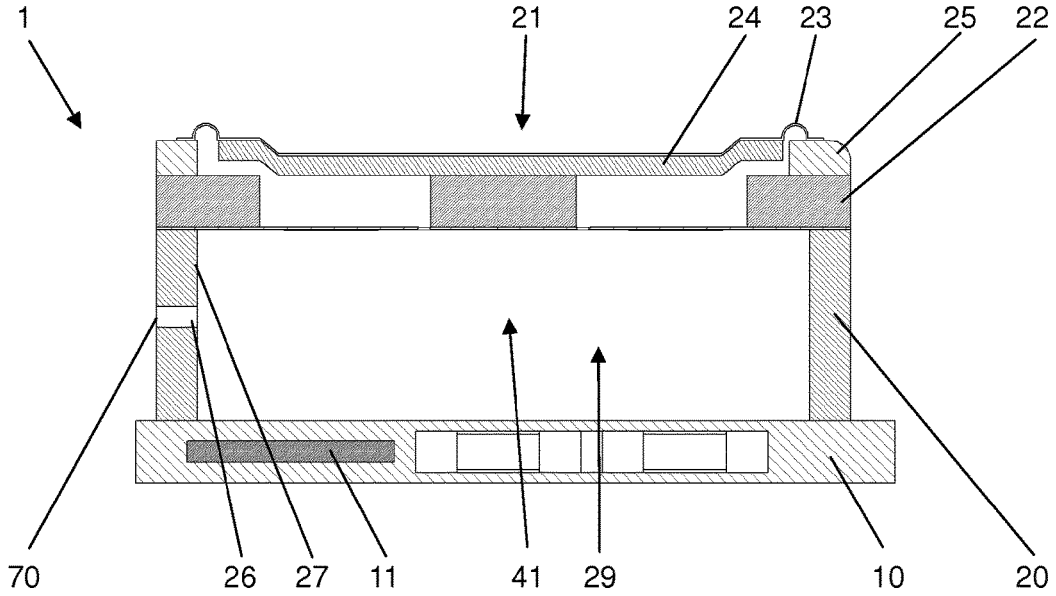
Figure 23:
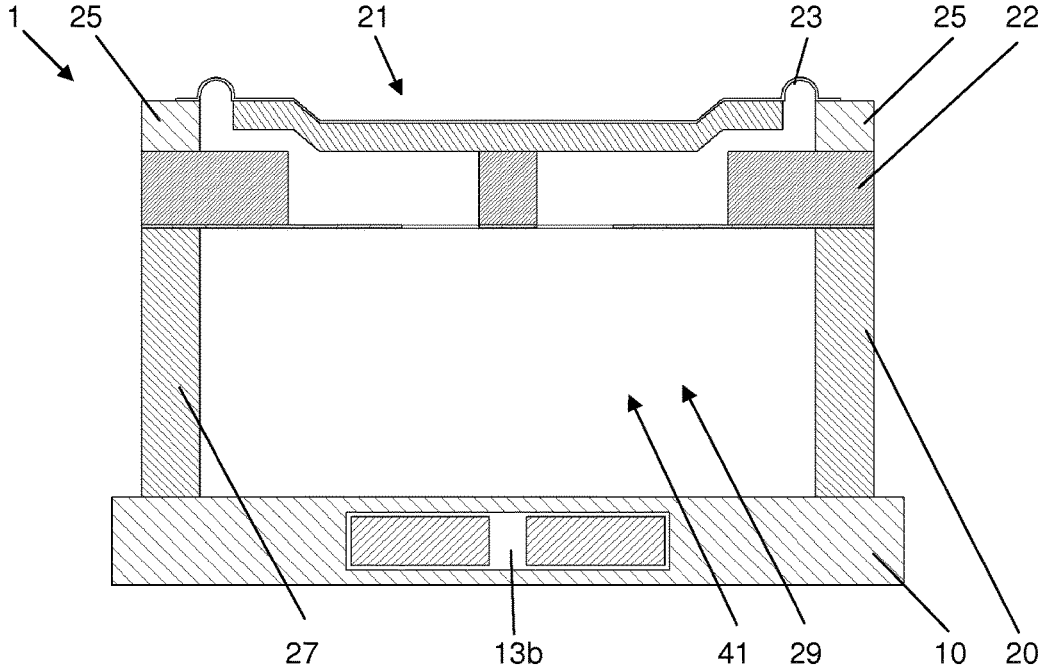

FIGS. 21 to 23 show an eleventh embodiment of the sound transducer assembly 1 in different views. In contrast to the first embodiment, with the eleventh embodiment of the sound transducer assembly 1, each of the second substrate 20, the MEMS actuator 22 and the membrane frame 25 of the first MEMS sound transducer 21 features the same outer diameter.

The walls 27 of the second substrate 20, which laterally bound the hollow space 29 of the second substrate 20, do not feature any wall sections that project into the hollow space 29, which would have to serve as supports for the MEMS actuator 22. Rather, the MEMS actuator 22 rests preferably in a full circumference on the walls 27 of the second substrate 20, whereas the membrane frame 25 also rests on the outer edge area of the MEMS actuator 22.

Thus, in this example as well, the second substrate 20 carries the MEMS actuator 22 along with the membrane frame 25 with the membrane 23 fastened to it, whereas the MEMS actuator 22 is arranged below the membrane 23 and whereas the second substrate 20 features the hollow space 29, which is closed upwards by the membrane 23, below the membrane 23 and the MEMS actuator 22.

Downwards, the hollow space 29 of the second substrate 20 is closed by the first substrate 10.

Figure 24:
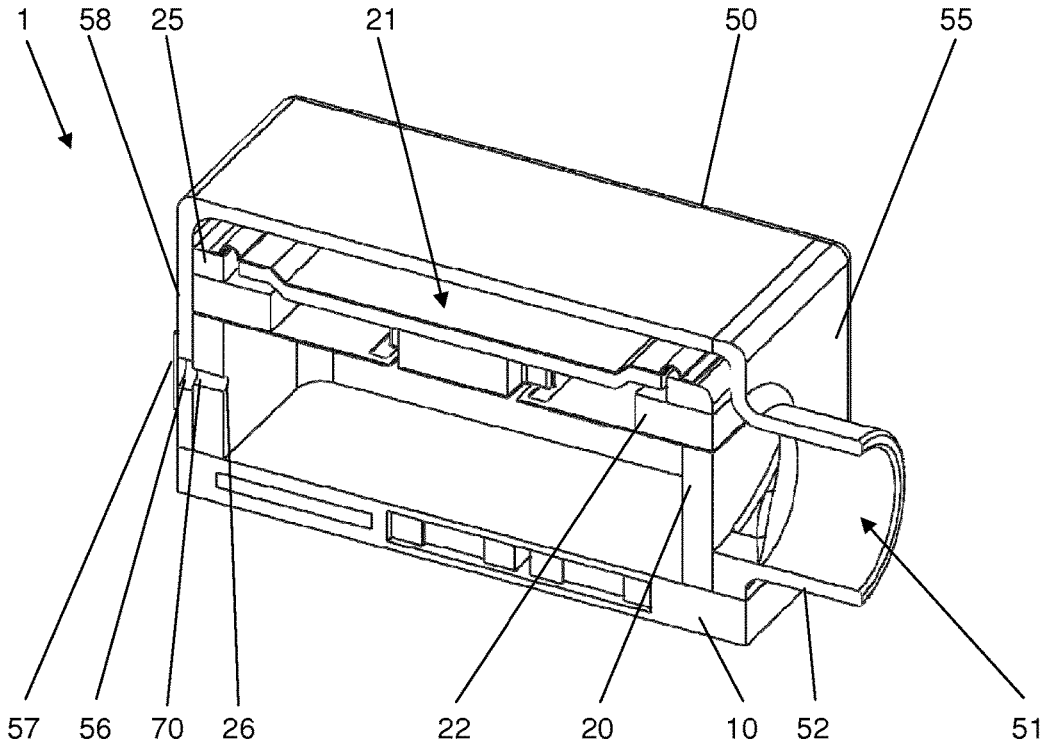
Figure 25:
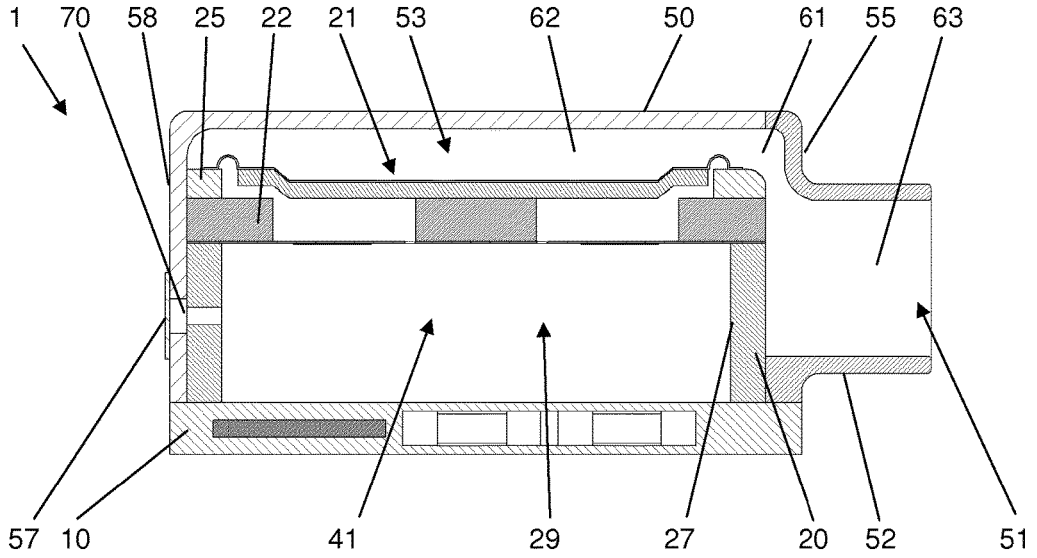
Figure 26:
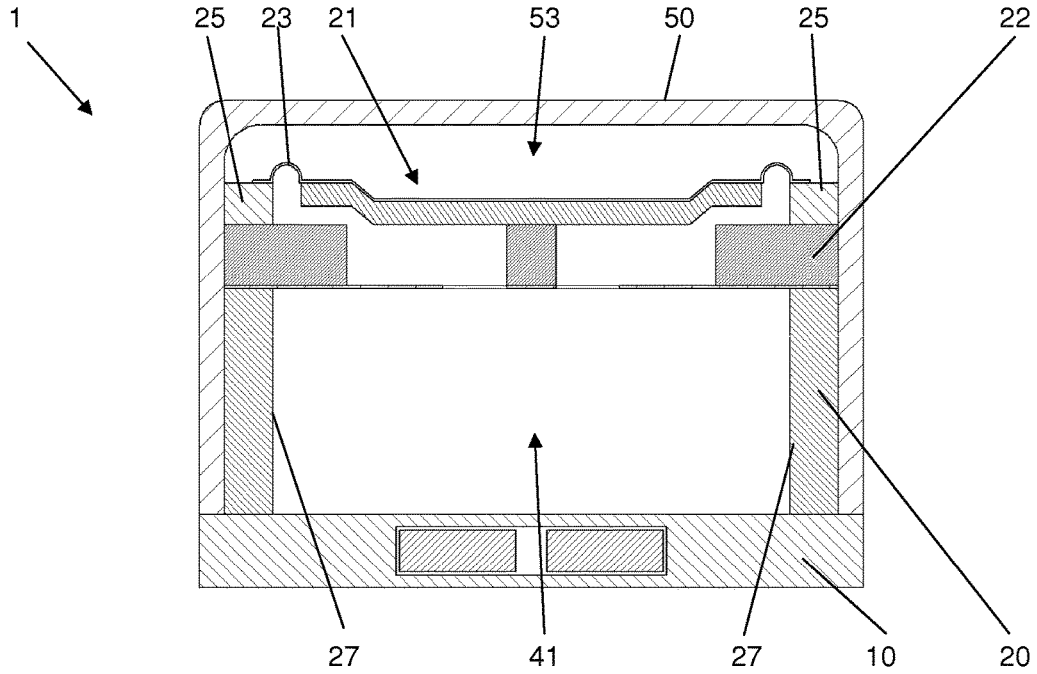

Moreover, with this embodiment, the cavity 41 of the MEMS sound transducer 21 formed by the hollow space 29 could be increased effectively and at the same time in a manner that saves installation space, FIGS. 24 to 26 show a twelfth embodiment of the sound transducer assembly 1 in different views. In contrast to the eleventh embodiment, with the twelfth embodiment of the sound transducer assembly 1, a housing part 50 is additionally provided, which is formed essentially like the second embodiment.

This invention is not limited to the illustrated and described embodiments. Variations within the scope of the claims, just as the combination of characteristics, are possible, even if they are illustrated and described in different embodiments.

LIST OF REFERENCE SIGNS

70 Pressure equalization channel
80 Additional substrate
87*a, b* Walls, wall sections
88 Projections, support
89 Hollow space
90 Connection opening

The invention claimed is:

1. Sound transducer assembly, comprising:

a first substrate and a first MEMS sound transducer for generating and/or detecting sound waves in the audible wavelength spectrum, the first MEMS sound transducer including a first cavity, an ASIC electrically connected to the first MEMS sound transducer and embedded in the first substrate, a second substrate in and/or on which the first MEMS sound transducer is arranged, and wherein the first substrate and the second substrate are connected to one another in such a manner that the ASIC and the first MEMS sound transducer are electrically coupled to one another;

a third substrate connected to the first substrate in an electrically conductive manner, wherein the first substrate is arranged between the second substrate and the third substrate;

a second MEMS sound transducer arranged in or on the third substrate and defining a second cavity; and wherein the first substrate defines an intermediate wall that is disposed to separate the first cavity of the first MEMS sound transducer from the second cavity of the second MEMS sound transducer.

2. Sound transducer assembly according to claim 1, further comprising a housing part, which defines an acoustic inlet/outlet opening, which is connected to at least one of the substrates in such a manner that at least one sound-conducting channel is formed at least partially between the housing part and the at least one of the substrates.

3. Sound transducer assembly according to claim 2, wherein the at least one sound-conducting channel defines a first section formed between the housing part and the at least one substrate.

4. Sound transducer assembly according to claim 2, wherein one of the first substrate, the second substrate and the third substrate is a PCB substrate, and at least one of the housing part and the sound-conducting element is composed of a material other than PCB.

5. Sound transducer assembly according to claim 2, further comprising a sound-conducting element that defines a concave, sound-conducting edge, which is arranged between the housing part and the at least one substrate in a transition region of the sound-conducting channel.

6. Sound transducer assembly according to claim 5, wherein each of the sound-conducting element and the sound-conducting edge is formed in such a manner that sound generated by the MEMS sound transducer can be bundled into the acoustic inlet/outlet opening.

7. Sound transducer assembly according to claim 5, wherein the sound-conducting element features an extension, which projects from the concave, sound-conducting edge.

8. Sound transducer assembly according to claim 1, wherein the first substrate and the third substrate are connected to each other by soldering or by gluing with an electrically conductive adhesive.

9. Sound transducer assembly according to claim 1, wherein the second cavity is formed at least partially in the third substrate.

10. Sound transducer assembly according to claim 1, wherein the first cavity defines a first volume, and the second cavity defines a second volume that differs from the first volume.

11. Sound transducer assembly according to claim 1, wherein the first substrate is arranged between and separates the first cavity from the second cavity.

12. Sound transducer assembly according to claim 1, wherein at least one of the first cavity and the second cavity is at least partially filled with a porous material.

13. Sound transducer assembly according to claim 1, wherein the intermediate wall defines at least one connection opening and a connection channel extending from the first cavity to the second cavity.

14. Sound transducer assembly according to claim 13, wherein the intermediate wall includes at least one stiffening element in the form of a rib.

15. Sound transducer assembly according to claim 1, further comprising a housing part, which defines an acoustic inlet/outlet opening, which is connected to at least one of the substrates in such a manner that at least one sound-conducting channel is formed at least partially between the housing part and the at least one of the substrates.

16. Sound transducer assembly according to claim 15, wherein the at least one sound-conducting channel defines a first section formed between the housing part and the at least one substrate.

17. Sound transducer assembly according to claim 15, further comprising a sound-conducting element that defines a concave, sound-conducting edge, which is arranged between the housing part and the at least one substrate in a transition region of the sound-conducting channel.

* * * * *